United States Patent [19]

Lovik

[11] Patent Number: 4,944,709

[45] **Date of Patent: * Jul. 31, 1990**

[54] BALLOON SCULPTURING METHODS, APPARATUS AND PRODUCTS

[76] Inventor: Craig J. Lovik, 8565 Custer School Rd., Custer, Wash. 98240

[ * ] Notice: The portion of the term of this patent subsequent to Jul. 25, 2006 has been disclaimed.

[21] Appl. No.: 369,634

[22] Filed: Jun. 21, 1989

Related U.S. Application Data

[62] Division of Ser. No. 183,720, Apr. 19, 1988, Pat. No. 4,850,926.

[51] Int. Cl.[5] ..... A63H 3/06; B65D 90/04

[52] U.S. Cl. ..... 446/221; 446/226; 220/401

[58] Field of Search ..... 446/220, 221, 222, 223, 446/224, 225, 226; 403/292, 298, 300, 170, 176; 206/457, 458; 220/401, 91

[56] References Cited

U.S. PATENT DOCUMENTS

| | | | |
|---|---|---|---|
| 723,292 | 3/1903 | Metzger | 446/221 X |
| 1,461,193 | 7/1923 | Larsen | 446/224 |
| 1,464,107 | 8/1923 | Pederson | 446/224 X |
| 1,483,150 | 2/1924 | Witten | 446/226 |
| 2,922,252 | 1/1960 | Van Dam et al. | 446/221 |
| 3,069,192 | 12/1962 | Hankus | 403/292 |
| 3,366,999 | 2/1968 | Darby | 446/222 |
| 4,586,456 | 5/1986 | Forward | 446/220 X |
| 4,589,854 | 5/1986 | Smith | 446/223 |
| 4,729,749 | 3/1988 | Milne | 446/222 |
| 4,850,926 | 7/1989 | Lovik | 446/222 |

*Primary Examiner*—Robert A. Hafer
*Assistant Examiner*—D. N. Muir
*Attorney, Agent, or Firm*—Cassidy, Vance & Tarleton

[57] ABSTRACT

Three-dimensional balloon sculptures (50, 56, 66, 86, 88, 89, 90, 99, 125, 136, 137, 159, 160, 169, 178, 186) and methods of forming same from one or more basic balloon building blocks (106, 106', 106'', 126, 159) each including at least one rigid lineal rod-like balloon former (**100, 100', 138*a*, 138*b*, 149, 162, 174, 181, 182, 184) defining one or more lineal barrier(s) precluding distension of a portion of the sidewall of a conventional balloon of the type having a constricted neck portion (111) terminating at one end in an inflation aperture (112) and at the other end in an imperforate inflatable sidewall (108). The rigid rod-like formers (100, 100') may be used either individually, in which event one or more balloons (108) may each be connected thereto at two (2) axially spaced points by: (i) passing the constricted neck portion (111) through one or more axially extending diametric slots (104, 105) formed in at least one end of the former (100, 100'); (ii) securing at least one of the constricted neck portion (111) and/or inflation aperture (112) to the former (100, 100'); and (iii), stretching the inflated balloon (108) along the unslotted length of the former (100, 100') and securing a portion (114) thereof to the former (100, 100') at a point spaced axially from the slotted end of the former (100, 100'), or by coupling two or more formers (100, 100') with balloons (108) attached thereto together by use of coupling devices (119, 130, 132, 143, 151, 152, 172, 175, 180). Alternatively, the rod-like formers (149, 162, 174, 181, 182, 184) may be coupled together to form a skeletal frame-like former (148, 161, 170, 179); and, composite balloon sculptures (160, 169**) may be formed from combinations of the foregoing.

6 Claims, 14 Drawing Sheets

BALLOON SCULPTURING METHODS, APPARATUS AND PRODUCTS

The present application is a division of Applicant's copending U.S. application Ser. No. 183,720 filed Apr. 19, 1988, entitled "Balloon Sculpturing Methods, Apparatus and Products", now U.S. Pat. No. 4,850,926.

Technical Field

The present invention relates generally to balloons; and, more particularly, to methods and apparatus for forming one or more balloons--which are of completely conventional construction--into diversely shaped, three-dimensional configurations or sculptures characterized by their unique, pleasant, aesthetic appearance and which find especially advantageous application as decorative centerpieces, decorative window displays, and a wide range of similar promotional and/or display purposes. In its broadest aspects, the invention also relates to the unique balloon sculptures resulting from employment of the method and apparatus aspects of the invention.

BACKGROUND ART

There are many widely divergent applications for usage of balloons to provide pleasing and decorative displays. Such applications range from the usage of one or more balloons in, for example: (i) home environments as centerpieces or other decorative displays commonly found at birthday and/or anniversary parties or the like; to (ii), uniquely shaped balloons which simulate animals, clowns, or the like and which are appealing to children or which can find application in window and/or other promotional displays; to (iii), relatively long, slender balloons which can be twisted together to form animal shapes; to (iv), conventional balloons arranged in clusters for decorative displays; to (v), usage by florists, catering services and the like in connection with the provision of flowers, foods and similar gifts which are being delivered to celebrate special occasions; etc.

However, despite the widespread usage of balloons for such special occasions as described above, there is an amazing dearth of patents relating to such decorative applications for balloons. Perhaps the most pertinent patent of which the present inventor is aware is U.S. Pat. No. 2,407,734—Bailliere which issued in 1946—viz., more than forty (40) years ago. Thus, the Bailliere patent relates to a toy and ball casing which consists of a pair of circular discs formed of flexible material, such as rubber, and which are sewn together at their peripheries. The discs are provided with a plurality of holes which preferably decrease in diameter towards the center of the discs so as to increase the lateral distendability of the discs. See, Col. 2, lines 28–43 of Bailliere. The patentee suggests that an inflated bladder be inserted into the interior space defined by the two (2) discs so that when the bladder is inflated, the discs are distended outwardly into a generally spherical shape defining a ball with slightly flattened poles. Bailliere recognizes that the bladder may constitute a ". . . conventional inexpensive balloon . . . " (See, Col. 3, lines 65–73); and, that when a thin wall bladder is employed within an outer flexible casing having some relatively large holes, the thin wall bladder can be inflated to a point where it will bulge outwardly slightly through the large holes in the casing as indicated in Bailliere FIG. 4. See, Col. 3, lines 47–54. Finally, Bailliere suggests at Col. 3, lines 54–61 that the bladder can be specially shaped so as to define, for example, four (4) legs which permit the bladder to be inserted into the interior of a specially shaped outer casing with the leg portions of the uninflated bladder projecting outwardly through respective ones of four (4) leg openings in the casing so that when the bladder is inflated, legs are formed to support the figure. See, Col. 3, lines 54–61.

A very similar suggestion is found in the even older 1930 patent issued to R. B. Weimer—viz., U.S. Pat. No. 1,755,161—wherein the inflatabe bladder may be shaped to simulate a dog and which can be inserted into a cardboard box-like structure.

In U.S. Pat. No. 1,635,969—Winkler, an inflatable toy is described comprising a balloon, a rigid collar, and supporting feet which enable the user to inflate the balloon with the collar constraining a medial portion of the balloon so as to form a head above the collar and a body below the collar; and, with the lower constricted neck portion/inflation aperture of the balloon being mounted in the supporting feet.

Other than the foregoing patents, the only other patents of which the present inventor is aware which are of even incidental interest are U.S. Pat. Nos. 2,922,252—Van Dam et al and 2,312,369—Solecki. Van Dam et al disclose a device wherein a plurality of balloons can be mounted at one end of a tubular support with the balloons being both individually inflatable and individually deflatable without having to remove them from the support; whereas Solecki merely discloses a wire-like holder for a conventional balloon.

However, while the patent art is most notable for its lack of attention to decorative balloon sculptures and/or displays, the practical commercial picture is quite different. Thus, balloon manufacturers and retailers have devoted literally hundreds of thousands of dollars to development and promotion of specialized balloon constructions and/or design configurations which are highly suitable for containing and/or visually portraying a wide range of messages, themes and/or visual appearances. Merely by way of example, the Pioneer Balloon Company of Wichita, Kansas (only one of several such manufacturer/retailers) has published, and continues to publish, virtually hundreds of promotional items ranging from single sheet full color brochures, to multi-page brochures, to balloon catalogs, and even to a publication entitled "The Balloon Book Designer's Guide", 1987 PBC (Pioneer Balloon Company). In the aforesaid Balloon Book Designer's Guide, a number of different applications are described in detail for making a wide range of decorative balloon sculptures. For example, at page 3 the authors describe methods for folding and/or twisting balloons to form a dove-like bird; at page 5 a system is described for attaching clusters of balloons to a monofilament fishing line using paper clips; and, at page 8 a system is described for attaching a multiplicity of balloons to a cardboard carton or a similar support core. Although apparently not described in detail in the Pioneer promotional materials, it is further known in the art that balloons can be secured together in clusters with tape. Other Pioneer Balloon Company publications of interest include: "The Balloon Book" © 1987 PBC; the "QUALATEX © (a registered trademark of PBC) Designer's Sketchbook"; "The Balloon Gallery"; and, the 1988 Edition of "QUALATEX ® Advertising Products including The Balloon Catalog".

However, while a considerable amount of time, effort and money has gone into the art relating to balloon design and/or balloon sculptures, and is continuing to go into that art today, not only by Pioneer Balloon Company but by other balloon manufacturers as well, the state of the art as it existed at the time of the present inventor's developmental work consisted basically of: (i) folding, twisting and tying off of one or more specially configured balloons to form a decorative object such as an animal; and (ii), forming decorative clusters of balloons by taping such balloons together, or attaching such balloons to a support with paper clips, and/or attaching such balloons to a box or similar core device by simply pushing the knotted inflation aperture of the inflated balloon into and through a small opening in the box or other core device.

SUMMARY OF THE INVENTION

The present invention overcomes all of the disadvantages of the known prior art approaches to balloon design by providing simple, effective and inexpensive methods and apparatus for: (i) shaping single completely conventional balloons into virtually any desired configuration ranging from simulated flowers and/or similar centerpieces to animal forms without the need of special talents for twisting, folding and knotting special balloons; and/or (ii), constructing a set of basic balloon building blocks by shaping single conventional balloons into a unique inflated configuration which is partially elliptical and partially crescent-shaped, being generally flat on one side or axial plane, somewhat ovate in all other axial planes, and tapered or pointed at its opposite ends, and thereafter coupling one or more other completely conventional balloons to the basic balloon building block and/or coupling multiple basic balloon building blocks together to form a decorative balloon sculpture. The present invention makes use of: (a) balloons which are completely conventional in shape and construction, although they may vary in size, color and/or printed matter appearing thereon; (b) a balloon former which may range from a simple, rigid, rod-shaped former to an open skeletal frame defined by rigid rod-like formers; and (iii), coupling devices for permitting two (2) or more basic balloon building blocks to be assembled together in a wide variety of configurations to form three-dimensional balloon sculptures having unique and pleasing aesthetic appearances.

In one of its simplest forms, the present invention contemplates the use of an open three-dimensional skeletal frame of rigid rod-like formers made of relatively thin strands of plastic, wire or the like and which permits of insertion of a conventional uninflated balloon into the interior thereof, with the skeletal frame-like formers being shaped such that upon inflation of the balloon, the latex sidewall material of the balloon projects outwardly through the openings of the skeletal frame-like formers to produce bulbous projections or lobes whose shape and size are determined: (i) by the degree of inflation; and (ii), by the shape of a given opening in the matrix of plastic and/or wire rod-like formers defining the skeletal frame-like former, with adjacent bulbous projections or lobes in some cases abutting one another in face-to-face relation, and thus totally overlying and concealing the skeletal frame-like former. Thus, by proper selection of the number, shapes and sizes of the openings in a particular skeletal frame-like former, a single conventional balloon, when inflated, can be made to assume virtually any desired shape and/or configuration, even including simulated floral arrangements, animals and/or the like; and, additionally, a single balloon can be configured to appear to be a multiplicity of balloons arranged in a cluster.

In another basic form of the invention, the basic balloon building block may simply take the form of a single rigid rod-like former made of clear acrylic or other plastic material, wood, or the like, and which is provided at one end with at least one, and in some cases two or more, diametric slot(s) which extend axially of the rod-like former only a relatively short distance from the slotted extremity. Thus, the arrangement permits the balloon designer or other user to: (i) partially inflate a conventional balloon; (ii) stretch the uninflated neck portion of the balloon through a diametric slot at one end of the rigid rod-like former; (iii), stretch the uninflated neck portion of the balloon extending beyond the diametric slot upwardly along the length of the rigid rod-like former with the inflation aperture of the balloon being stretched over and about either the unslotted end of the rod-like former or a mounting lug formed thereon; and (iv), stretch the apex of the partially inflated portion of the balloon most remote from the inflation aperture over and about either the unslotted end of the rod-like former or a mounting lug formed thereon.

The arrangement is such that the basic balloon building block resulting from the foregoing process comprises an inflated balloon having: (i) one generally flat plane adjacent one side of the rod-like former and extending along the unslotted length thereof; (ii) generally ovate lobes projecting laterally from the rod-like former throughout an angle of approximately 180°; and (iii), tapered or pointed ends at both the unslotted end of the rod-like former and at the base of the diametric slot(s). As a consequence, the balloon designer or other user can insert the inflation aperture and knotted constricted neck of other conventional small inflated balloons through the axially extending region between the rigid rod-like former and the ovately shaped balloon mounted thereon with such additional balloons being frictionally retained in place; and/or the balloon designer or other user can mount one or more additional balloons on the rod-like former in precisely the same manner as previously described and using the same diametric slot so as to form a basic balloon building block comprising two (2) or more balloons having inwardly facing flat planes between which the rod-like former extends; and/or, wherein the rod-like former includes two (2) or more intersecting diametric slots so as to permit the mounting of two (2), three (3), four (4) or more balloons on a single rod-like former to form a three-dimensional balloon sculpture or basic balloon building block having two (2), three (3), four (4) or more essentially identical shaped, inflated, ovately shaped segments surrounding and coextensive with the rod-like former, thus totally concealing the same. Such basic balloon building blocks may be mounted in a support base by simply inserting the slotted end of the rod-like former into a bore formed therein; and, a single support base may be designed with a multiplicity of such bores extending in different directions so as to allow a multiplicity of separate basic balloon building blocks to be mounted therein to form a floral spray or similarly shaped centerpiece. Moreover, tubular connectors may be positioned over either end of the rod-like former to permit multiple rod-like formers to be assembled in end-to-end relation. Alternatively, rigid connector pins may be employed to couple two (2) or more formers together in end-to-end coaxial relation. In yet another modification of the invention, a generally disc shaped coupler having axial and/or radial and/or other angularly related bores can be mounted on at least one end of the rod-like former, thus permitting coupling of two (2) such formers in end-to-end relation and/or permitting coupling of a multiplicity of rod-like formers to a single disc-like coupler having a multiplicity of bores formed therein. In this manner, the basic balloon building block can be assembled with similar blocks to simulate arches or virtually any other three-dimensional configuration. Indeed, a plurality of basic balloon building blocks can be assembled to an upright standard so as to define the outwardly and upwardly extending limbs of a Christmas tree with individual basic balloon building blocks including balloons of widely different colors to produce an aesthetic appearance simulating a Christmas tree having ball-like decorations or ornaments mounted on the simulated branches thereof.

DESCRIPTION OF THE DRAWINGS

These and other objects and advantages of the present invention will become more readily apparent upon reading the following Detailed Description and upon reference to the attached drawings, in which:

FIGS. 1 through and including 8 are isometric elevational views of a variety of exemplary balloon sculptures that can readily be formed in accordance with the methods of, and utilizing the apparatus of, the present invention; and, wherein:

FIG. 1 comprises an isometric view of a balloon sculpture simulating an open pea pod with the peas exposed and consisting of ten (10) completely conventional balloons and a single rigid rod-like balloon former;

Figure 1:
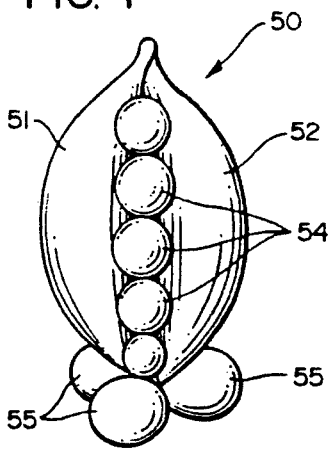

While the invention is susceptible of various modifications and alternative forms, specific embodiments thereof have been shown by way of example in the drawings and will herein be described in detail. It should be understood, however, that it is not intended to limit the invention to the particular forms disclosed but, on the contrary the intention is to cover all modifications, equivalents and alternatives falling within the spirit and scope of the invention as expressed in the appended claims.

DETAILED DESCRIPTION

Turning now to the drawings, there have been illustrated, in respective different ones of FIGS. 1–8, eight (8) purely exemplary balloon sculptures which have been created employing the features of a first embodiment of the present invention described more fully in detail hereinbelow. Thus, referring first to FIG. 1, a balloon sculpture, generally indicated at 50, made in accordance with the present invention has been depicted, such balloon sculpture here being visually representative of an open pea pod including: (i) a pair of at least partially ovately shaped balloons 51, 52 representing the left and right halves, or shells, of an open pea pod; (ii) five (5) smaller, generally spherical balloons 54 representative of the peas contained within the pod; and (iii), three (3) intermediate sized, generally spherical balloons 55 arranged in a cluster and constituting a base for supporting the pea pod balloon sculpture 50 in an upright condition.

As will become apparent to those skilled in the art as the ensuing description proceeds, while the balloons 51, 52 appear to be of unusual shape, being at least partially ovate, all of the balloons 51, 52, 54, 55 employed in the balloon sculpture 50 shown in FIG. 1 are completely conventional balloons in terms of shape, size, material and color; but, the degree and manner of inflation thereof have been controlled in accordance with the invention to produce individual shapes and sizes which vary dependent upon the visual impression that the particular balloon designer wishes to create. For example, while the color of the balloons is not critical to the invention, the balloon designer will preferably select balloons having colors that are consistent with the impression that the designer is attempting to create. For example, in FIG. 1 where the sculpture 50 is intended to simulate an open pea pod, the balloons 51, 52 representative of the pod, or shell, would preferably be green in color, as would the five (5) smaller balloons 54 representative of the peas; although the balloons 54 might be a slightly lighter and/or brighter shade of green than the green of the balloons 51, 52. The three (3) intermediate sized balloons 55 utilized for the base might be of a different color such, for example, as red to simulate tomatoes, or any other color or colors dependent solely upon the visual impression desired.

Figure 2:
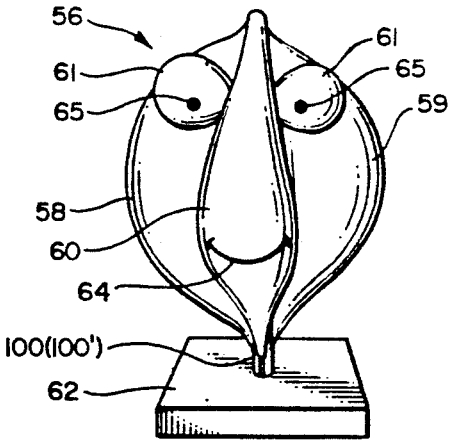
FIG. 2 is an isometric view of a cluster of balloons so arranged on an assemblage of balloon formers as to simulate a clown's face.

Turning to FIG. 2, another exemplary balloon sculpture, generally indicated at 56, has been depicted employing essentially the same basic balloon building block as used in formation of the pea pod balloon sculpture 50 of FIG. 1, although in this instance the balloons have been configured to simulate a rather simple clown's face. Thus, in this sculpture, a total of five (5) balloons have be employed—viz., three (3) generally ovately shaped balloons 58, 59, 60 arranged in a cluster around a common vertical axis; and, two (2) smaller, generally spherical balloons 61 simulating the clown's eyes. The entire sculpture 56 is supported on a pedestal or base 62 in a manner hereinafter described in greater detail. In balloon sculptures of this type, the designer may, if desired, utilize a grease pencil or similar writing implement to add a mouth 64 to the ovate balloon 60 which also serves to simulate the clown's nose and/or pupils 65 to the relatively small balloons 61 simulating the clown's eyes—balloons which might, for example, be white in color.

Figure 3:
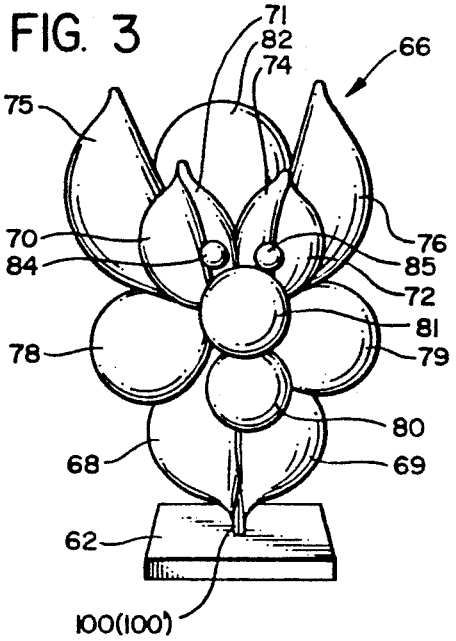
FIG. 3 is an isometric view of a somewhat more complex cluster of balloons arranged on individual rigid balloon formers and assembled to simulate, in somewhat abstract form, a clown's head.

Yet another exemplary balloon sculpture—in this case, a rather abstract form of a clown's head, generally indicated at 66—has been illustrated in FIG. 3. As here shown, the balloon sculpture 66 includes a total of fifteen (15) balloons—viz., a first pair of generally ovately shaped balloons 68, 69 representative of the clown's jaw and neck; second and third pairs of generally ovately shaped balloons 70, 71 and 72, 74 simulating the forehead of the clown; a fourth pair of generally ovately shaped balloons 75, 76 simulating bushy clumps of hair on the sides of the clown's head; first and second spherical balloons 78, 79 simulating the clown's cheeks; third and fourth spherical balloons 80, 81 respectively simulating the clown's mouth and nose; a fifth spherical balloon 82 simulating the crown of the clown's head; and, sixth and seventh relatively small spherical balloons 84, 85 simulating the clown's eyes. Again, the entire assembly of balloons defining the balloon sculpture 66 is here shown as supported on a base or pedestal 62 in a manner more fully described hereinbelow.

Figure 4:
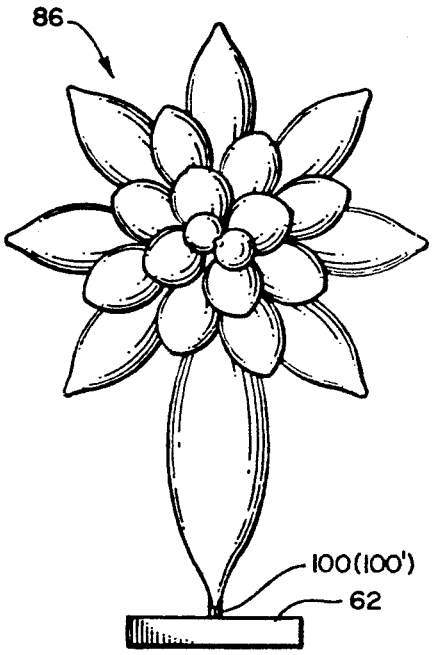
FIG. 4 is an isometric view of a multiplicity of balloons each mounted on individual rigid rod-like balloon formers and assembled in a cluster to simulate a floral spray that might be used as a centerpiece.
Figure 5:
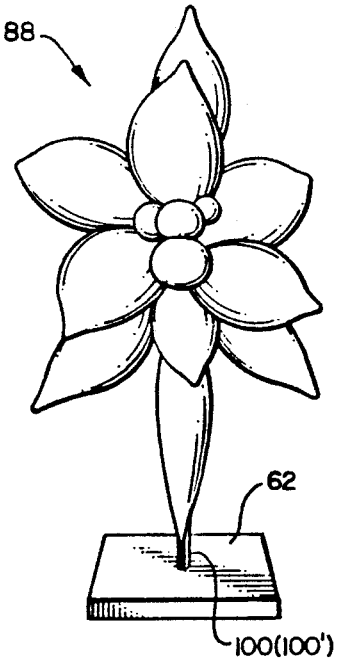
FIG. 5 is an isometric view of yet another cluster of balloons each individually mounted on a rigid rod-like balloon former and assembled together to form a decorative centerpiece.
Figure 6:
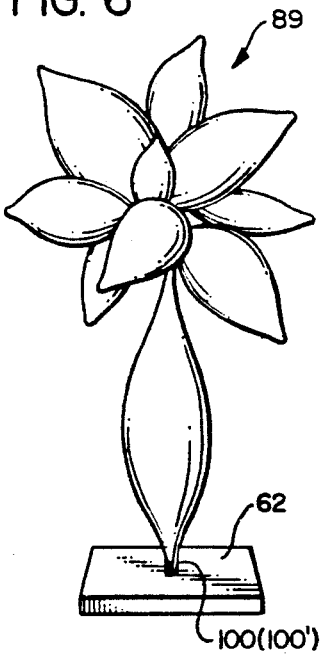
FIG. 6 is an isometric view similar to FIG. 5, but illustrating a somewhat differently shaped balloon centerpiece made in accordance with the present invention.

Referring next to FIGS. 4, 5 and 6 conjointly, three (3) other purely exemplary balloon sculptures, generally indicated at 86 (FIG. 4), 88 (FIG. 5) and 89 (FIG. 6), have been depicted which are also made in accordance with the present invention. In each instance, the exemplary balloon sculpture is designed to simulate a floral arrangement which might find advantageous use as a centerpiece or other type of display. Thus, the floral-like balloon sculpture 86 of FIG. 4 comprises a fairly complex sculpture consisting of twenty-two (22) balloons; whereas the floral balloon sculpture 88 of FIG. 5 is considerably less complex, employing only fourteen (14) balloons, and the balloon sculpture 89 of FIG. 6 is even less complex, employing only ten (10) balloons.

Figure 7:
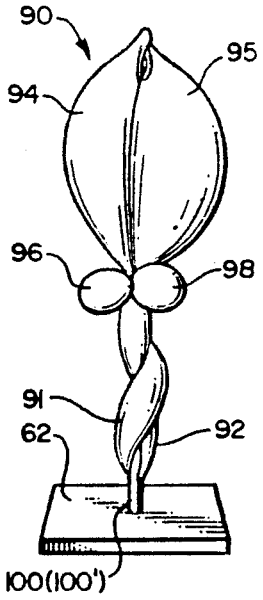
FIG. 7 is an isometric view of yet another balloon sculpture made in accordance with the present invention, here illustrating a somewhat different arrangement including: (i) two (2) completely conventional balloons wrapped around a rigid rod-like balloon former in a spiral configuration and secured thereto; (ii) a basic balloon building block incorporating features of the present invention; and (iii), a pair of small spherical balloons, all assembled together to simulate a flower bud; and, FIG. 8 is an isometric view of yet another exemplary balloon sculpture made in accordance with the present invention, here simulating a Christmas tree.

As thus far generally described, the balloons employed in constructing the various balloon sculptures 50, 56, 66, 86, 88 and 89 of FIGS. 1–6, respectively, have been of varying sizes but which are basically of only two (2) shapes when inflated and mounted in the sculpture—viz., either generally spherical or at least partially ovate. However, the invention is not so limited as can be appreciated by inspection of FIG. 7 depicting a balloon sculpture, generally indicated at 90, which here includes a pair of relatively elongate balloons 91, 92 arranged in a twisted spiral-like configuration simulating a vine terminating at its upper end in a pair of ovately shaped balloons 94, 95 simulating an unopened flower bud and a pair of small spherical balloons 96, 98 simulating leaves.

Figure 8:
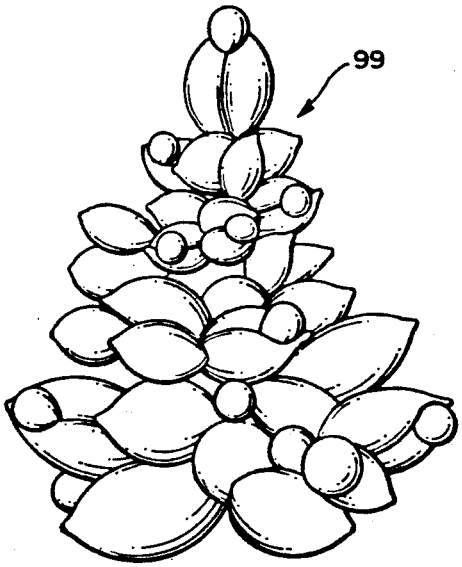

Finally, referring to FIG. 8, it will be noted that a balloon sculpture, generally indicated at 99, has been depicted comprising a multiplicity of balloons which have been assembled in accordance with the present invention to simulate a Christmas tree. Again, those skilled in the art will appreciate that the balloon designer may select from a wide variety of different sized and different colored balloons to create the desired impression; but, those balloons which are intended to simulate the tree's foliage would preferably be green in color, while those balloons simulating decorative balls or ornaments might be of any color such, for example, as gold, silver, white, blue, yellow, green, red, etc. Indeed, those balloons simulating decorative balls or ornaments might even be treated as disclosed in my copending U.S. patent application, Ser. No. 299,310, filed , Jan. 23, 1989 so as to render them phosphorescent, thereby creating a dramatic aesthetic appearance when the sculpture 99 is viewed in the dark.

As the ensuing description proceeds, those skilled in the art will appreciate that the foregoing eight (8) exemplary balloon sculptures 50, 56, 66, 86, 88, 89, 90 and 99 depicted in respective different ones of FIGS. 1–8 are merely illustrative of a virtually unlimited number of sculptures that can be formed wherein the only limitation is that resulting from the designer's own creativity. Therefore, it will be understood that such exemplary sculptures have been shown and described merely for purposes of illustration and not by way of limitation.

Figure 9:
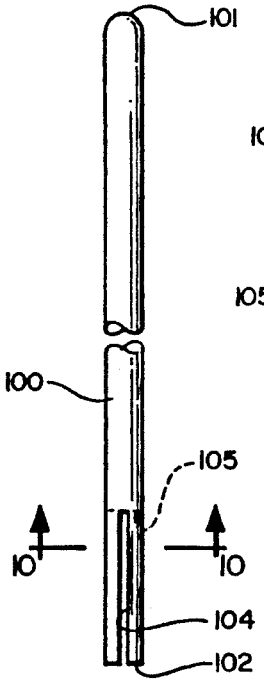
FIG. 9 is an elevational view of an exemplary rigid rod-like balloon former which is particularly suitable for use in creating a basic balloon building block embodying features of the present invention and suitable for fabricating a wide variety of balloon sculptures including, merely by way of example, those exemplary sculptures shown in FIGS. 1–8.
Figure 10:
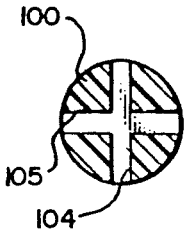
FIG. 10 is a sectional view taken substantially along the line 10—10 in FIG. 9, here illustrating details of the slotted end of the exemplary rigid rod-like balloon former of FIG. 9.
Figure 11:
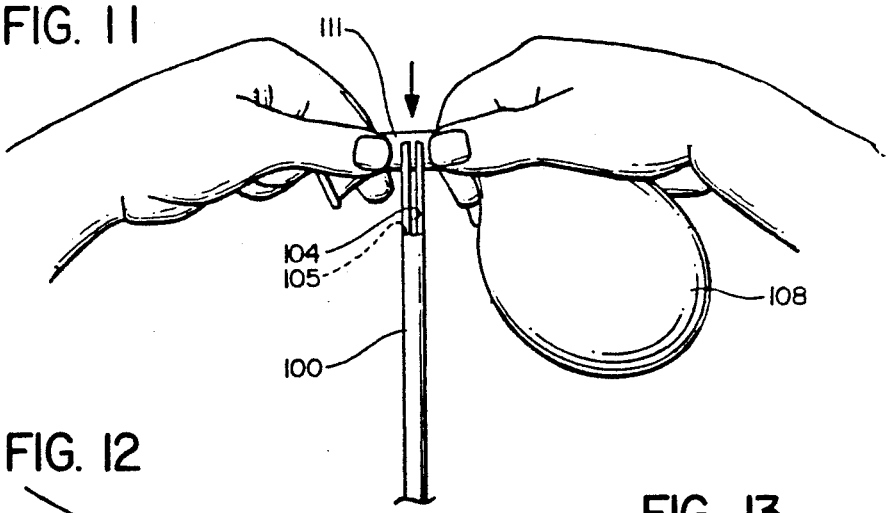
FIG. 11 is a fragmentary isometric view illustrating the first step in accordance with one method for attaching a partially inflated balloon to the rigid rod-like balloon former of FIG. 9, here illustrating how the uninflated constricted neck portion of the balloon is passed through the slotted end of the former.

Referring next to FIGS. 9 and 10, one of the basic components of a first embodiment of the present invention has been illustrated, such embodiment being that employed in the formation of all of the exemplary balloon sculptures of FIGS. 1–8. Thus, as here shown, the present invention contemplates the usage of a rigid rod-like balloon former 100 which may be of virtually any desired length and which is preferably formed of clear acrylic or other plastic material, although such former 100 can be made from a wide range of other materials including wood or similar natural materials and/or metals or similar synthetic materials. In any event, one end of the exemplary rigid rod-like balloon former 100—here the upper end 101 as viewed in FIG. 9—is preferably rounded or dome shaped so as to be devoid of sharp edges; while the opposite end—here, the lower end 102 as viewed in FIG. 9—is preferably provided with at least one axially extending diametric slot 104 and, in the exemplary device, with a pair of intersecting diametric axially extending slots 104, 105 as best shown in FIG. 10.

Figure 12:
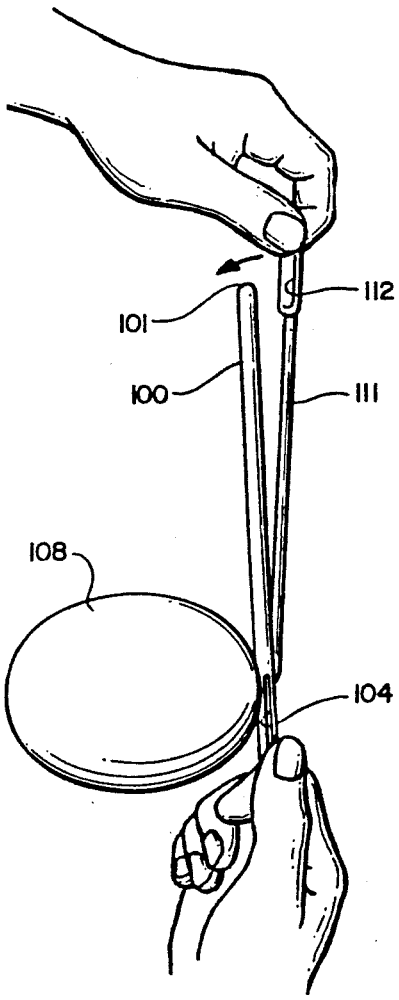
FIG. 12 is a fragmentary isometric view illustrating particularly an exemplary second step that can be employed in order to attach a partially inflated balloon to the rigid rod-like balloon former of FIG. 9, here illustrating how the uninflated constricted neck portion of the balloon projecting through the slotted end of the former is stretched upwardly , along the unslotted length of the former with the inflation aperture being mounted over and about the unslotted end of the former.
Figure 13:
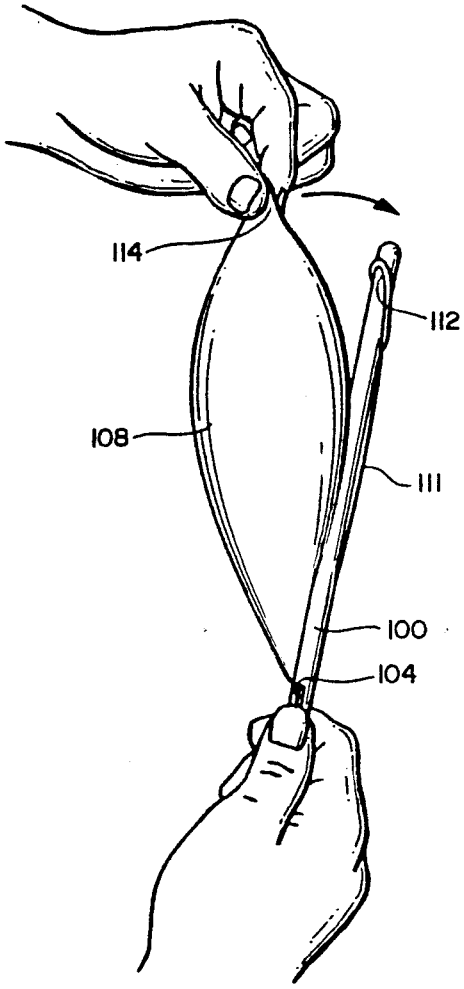
FIG. 13 is a fragmentary isometric view illustrating an exemplary third step that can be employed when attaching the apex of a partially inflated conventional balloon—i.e., that inflated portion of the balloon most remote from the inflation aperture thereof—to the unslotted end of the rigid rod-like balloon former of FIG. 9.
Figure 14:
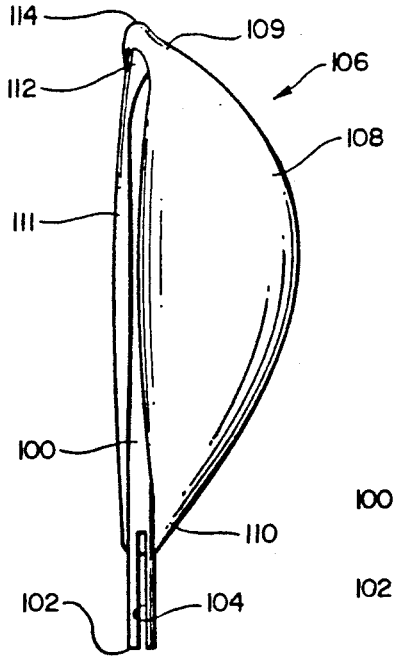
FIG. 14 is a side elevational view of a single conventional balloon as fully assembled on the rigid rod-like balloon former of FIG. 9 to form a simple basic balloon building block.

In accordance with one of the important aspects of the present invention, and as best appreciated by reference to FIGS. 11–16 conjointly, the exemplary rigid rod-like balloon former 100 depicted in FIGS. 9 and 10 is employed to enable formation of a basic balloon building block, generally indicated at 106 in FIG. 14, including at least one (1) conventional balloon 108 configured in a generally ovate shape having: (i) one generally flat planar side adjacent the rod-like former 100; (ii) tapered or pointed upper and lower extremities 109, 110, respectively; and (iii), being generally ovate in all other axial planes—i.e., the basic balloon building block 106 of FIG. 14 serves to form those ovately shaped portions of the pea pod sculpture 50 of FIG. 1 indicated at 51, 52, etc. To accomplish this, and as best shown by reference to FIGS. 11–13, the balloon designer or other user needs only to partially inflate a completely conventional balloon 108 and insert the uninflated constricted neck portion 111 of the balloon through one of the diametric slots 104, 105 in the exemplary rigid rod-like balloon former—for example, through the slot 105 shown in FIG. 10, which slot is not clearly visible in FIGS. 11–13, but in the manner depicted in FIG. 11. Thereafter, the uninflated constricted neck portion 111 of the balloon 108 is stretched axially along the unslotted length of the rigid rod-like balloon former 100 as best shown in FIG. 12; and, the inflation aperture 112 of the balloon 108 is then stretched over and about the upper rounded end of the former 100 in the manner shown by reference to FIGS. 12 and 13 conjointly, thereby effectively sealing the balloon 108 in its partially inflated state without having to knot or otherwise tie off the constricted neck portion 111 of the balloon 108 in the normal manner. Finally, the designer or other user need merely grasp a portion of the sidewall of the partially inflated balloon--generally, but not necessarily, the apex portion thereof indicated at 114 in FIG. 13 (i.e., the portion most remote from the inflation aperture 112)—and, thereafter stretch the partially inflated balloon 108 upwardly along the rigid rod-like former 100 in the manner shown in FIG. 13, positioning the stretched apex portion 114 over and about the uppermost end 101 of the rod-like former 100 and the inflation aperture 112 of the balloon in surrounding relation thereto, whereby the balloon 108 is fixedly mounted in sealed relation on, and resiliently retained captive on, the rigid rod-like balloon former 100, thereby creating a simple, but uniquely shaped, basic balloon building block such as depicted at 106 in FIGS. 14–16.

Figure 15:
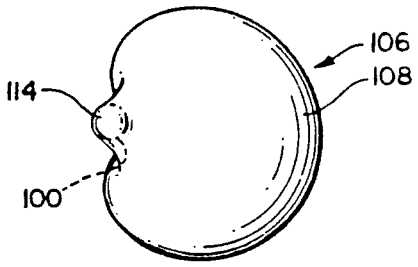
FIG. 15 is a top plan view of the simple basic balloon building block of FIG. 14, here illustrating particularly the essentially flat planar configuration of that portion of the balloon sidewall which lies adjacent to the rod-like balloon former.

The uniquely shaped basic balloon building block 106 thus formed is, as previously indicated, characterized by its shape which is, as a result of the presence of the rigid rod-like former 100 which serves as a lineal barrier precluding distension of the balloon sidewall in one direction—viz., to the left as viewed in FIGS. 14 and 15—generally flat along that side immediately adjacent the former 100, while having generally ovately shaped, laterally extending lobes throughout an angle of approximately 180° in all other axial planes, and being pointed or tapered at its uppermost and lowermost extremities 109, 110. Moreover, the lower slotted end 102 of the rigid rod-like former permits the basic balloon building block 106 to be easily mounted in a base or pedestal 62 merely by insertion of the lower end 102 of the former into a bore 115 formed in the base 62, as best shown in FIG. 16.

Figure 17:
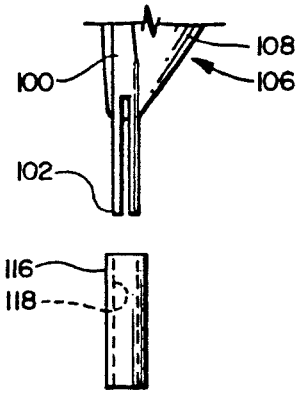
FIG. 17 is a fragmentary, partially exploded, side elevational view depicting two (2) simple basic balloon building blocks each essentially identical to that shown in FIGS. 14–16 and which are adapted to be assembled in end-to-end relation by means of an intermediate coupling device here taking the form of an acrylic or clear plastic tube.
Figure 18:
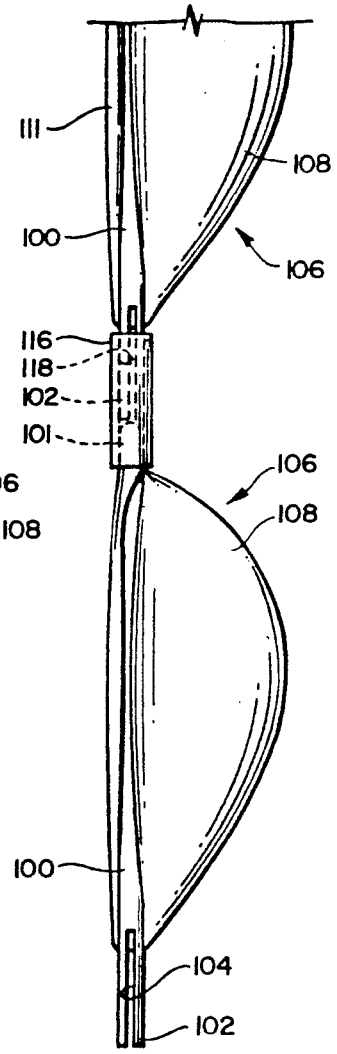
FIG. 18 is a fragmentary side elevational view of the two (2) basic balloon building blocks and intermediate coupling device of FIG. 17 in assembled condition.
Figure 16:
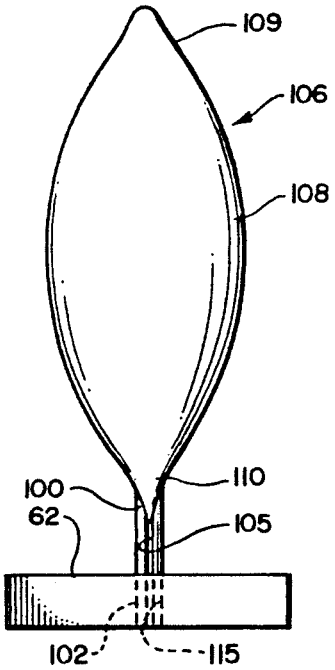
FIG. 16 is a front elevational view of the simple basic balloon building block of FIGS. 14 and 15, but here illustrating the building block mounted in a support base enabling the building block to stand in an erect state.
Figure 16:
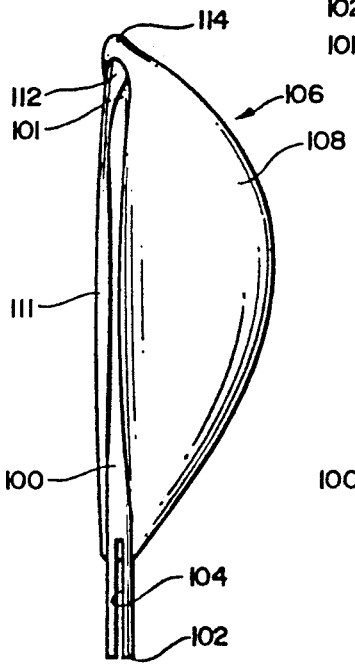

In keeping with the present invention, provision is made for enabling a plurality of basic balloon building blocks—such, merely by way of example, as that indicated at 106 in FIGS. 14–16—to be coupled together in coaxial end-to-end relation. Thus, as best shown in FIGS. 17 and 18, two (2) basic balloon building blocks 106 are disposed in end-to-end coaxial relation with an intermediate coaxial coupling device 116 which here takes the form of a tube, preferably formed of clear acrylic or other plastic material, having an internal axial bore 118 dimensioned to snuggly receive: (i) the uppermost end 101 of a first rigid rod-like former 100 for a first basic balloon building block 106, such uppermost end 101 having the inflation aperture 112 and apex portion 114 of a partially inflated balloon 108 stretched thereover; and (ii), the lowermost slotted end 102 of a second rigid rod-like former 100 for a second basic balloon building block 106. Thus, the arrangement readily permits the formation of "strings" of basic balloon building blocks 106 which can, of course, be relatively rigid and self-supporting or flexible dependent upon the length, thickness and flexibility of the material from which the tubular coupling device 116 is formed.

Figure 19:
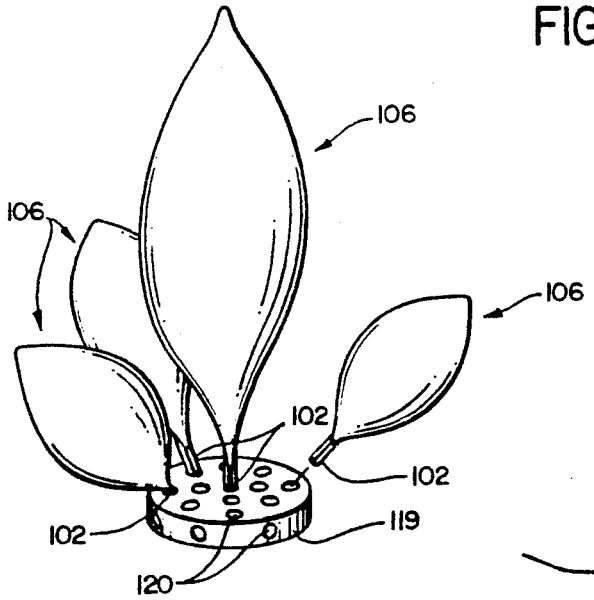
FIG. 19 is a fragmentary, partially exploded, isometric view depicting a plurality of essentially identical basic balloon building blocks and a modified coupling device capable of being used to assemble a multiplicity of such building blocks into a cluster of balloons in a radiating spray arrangement.

Alternatively, the coupling device can take the form of a disk of circular or other configuration, such as indicated at 119 in FIG. 19, with such disk 119 being provided with a plurality of bores 120 that can be radial, axial and/or disposed at angles. Thus, in the arrangement depicted in FIG. 19, the bores 120 formed in the upper surface of the disk-like coupling device 119 permit the mounting of a plurality of basic balloon building blocks 106 therein in a radiating, flared or three-dimensional fan-shaped array as shown. Of course, when the disk-like coupling device 119 is provided with a similar pattern of bores in its lower surface (not visible in FIG. 19), the coupling device 119 can also serve to support two (2) basic balloon building blocks 106 in coaxial end-to-end relation with a plurality of additional basic balloon building blocks extending in any one or more of: (i) upward and outward directions from the bores 120 in the upper surface of the disk-like coupling device 119; (ii) radial directions from the bores 120 in the periphery of the disk-like coupling device 119; and/or (iii), downwardly and outwardly from the bores (not shown) in the lower surface of the disk-like coupling device 119.

Figure 20:
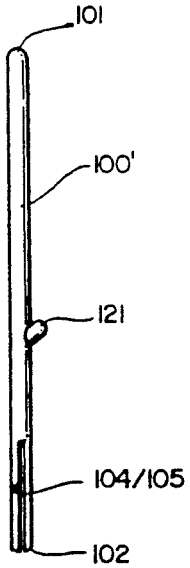
FIG. 20 is an isometric view of a modified form of rigid rod-like balloon former somewhat similar to that shown in FIG. 9 and also embodying features of the present invention.
Figure 21:
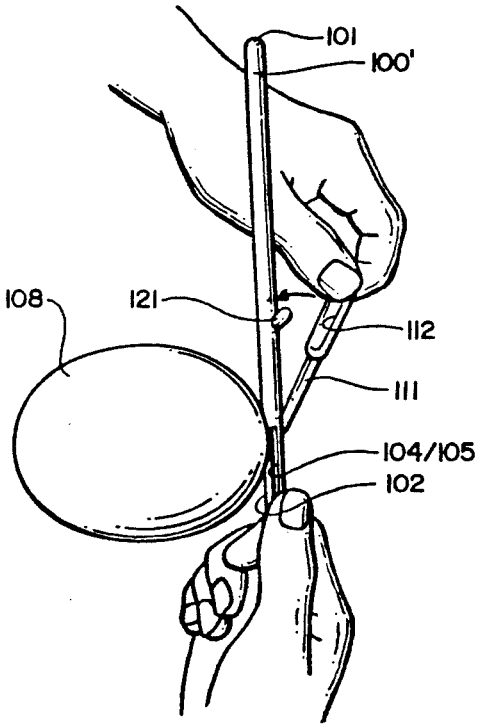
FIG. 21 is a fragmentary isometric view similar to FIGS. 11 and 12, but here illustrating the initial steps that might be employed in attaching a partially inflated balloon to the modified balloon former depicted in FIG. 20.
Figure 22:
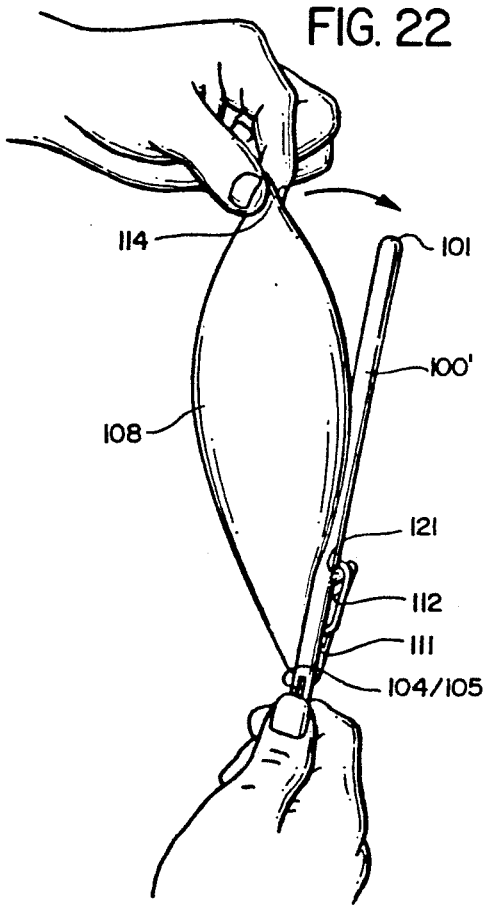
FIG. 22 is a fragmentary isometric view similar to FIG. 13 illustrating the final step that can be employed to attach the apex of the partially inflated balloon of FIG. 21 to the modified balloon former depicted in FIG. 20.

Turning next to FIGS. 20–22, a slightly modified rigid rod-like balloon former 100' has been shown which is essentially identical to that shown at 100 in FIG. 9 except that the modified rod-like balloon former 100' includes at least one upwardly and outwardly extending short mounting lug 121 formed on the unslotted length of the rod-like former 100'. Thus, in use of the modified form of rod-like balloon former 100': (i) a completely conventional balloon 108 is partially inflated; (ii) the uninflated constricted neck portion 111 of the balloon 108 is passed through a slot 104/105 formed in the lower end of the former 100' as shown in FIG. 21, all in precisely the same manner previously described in connection with FIG. 11; (iii) the inflation aperture 112 of the balloon 108 is stretched over and about the mounting lug 121; and (iv), a portion 114 of the partially inflated balloon 108 is stretched upwardly over and about the upper end 101 of the modified rigid rod-like former 100'. Indeed, as best viewed in FIG. 23—a bottom view of a modified basic balloon building block 106'—two (2), three (3) or more partially inflated balloons [here, three (3) such balloons **108*a*, 108*b*, 108*c*] can be mounted on a single rod-like former which can be of the type shown at 100 in FIG. 9 or at 100' in FIG. 20 so as to create the modified basic balloon building block 106'**.

Figure 23:
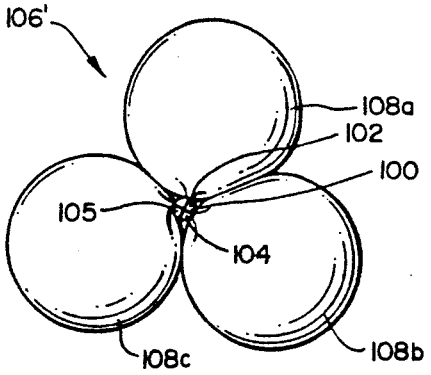
FIG. 23 is a bottom plan view of a basic balloon building block employing the modified balloon former of FIG. 20 after attachment of three (3) separate completely conventional balloons thereto in the manner described in conjunction with FIGS. 21 and 22.
Figure 24:
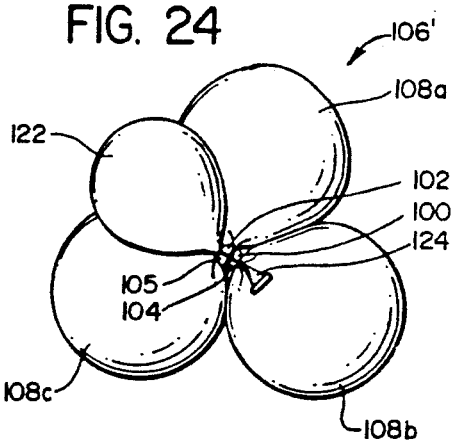
FIG. 24 is a bottom plan view of the basic balloon building block of FIG. 23, but here illustrating an alternative method for attaching one (1) of a plurality of relatively small conventional balloons to the slotted end of the basic balloon building block of FIG. 23 so as to enable formation of a compact cluster of radially disposed small balloons in surrounding relation to the slotted base of the balloon former.
Figure 25:
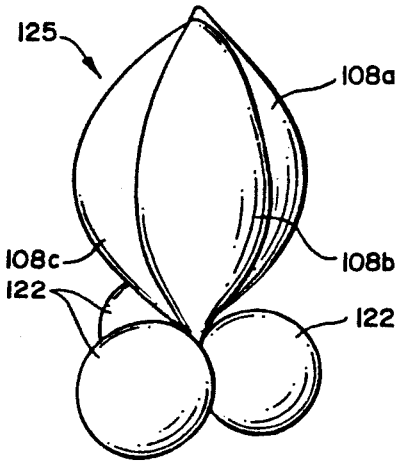
FIG. 25 is an isometric view of an exemplary balloon sculpture resulting from the steps depicted in FIGS. 21 through and including 24.

Referring to FIG. 24, it will be noted that at least one (1) fourth, somewhat smaller, generally spherical balloon 122 can also be mounted at the base of the modified basic balloon building block 106'—for example, by knotting or tying off the constricted neck portion 124 of the balloon 122 in a conventional manner, as shown, and passing the constricted neck portion 124 through one (1) of the slots 104/105. Alternatively, and while not shown in FIG. 24, the constricted neck portion 124 of the balloon 122 can be: (i) passed through one (1) of the slots 104/105 without prior knotting thereof; (ii) wrapped around the lower slotted end 102 of the former 100, 100'; and (iii), again passed through one (1) of the slots. Indeed, two (2), three (3) or more small balloons 122 can be mounted at the lowermost end of the modified basic balloon building block 106' of FIGS. 23 and 24 so as to form a support base for a balloon sculpture such as that generally indicated at 125 in FIG. 25.

Having in mind the foregoing basics of balloon design employing a balloon former embodying features of the present invention and of the types described above in conjunction with FIGS. 9–25, attention will next be directed to FIGS. 26–30 wherein the progressive steps employed to form the exemplary pea pod balloon sculpture 50 of FIG. 1 will be described. Thus, referring first to FIG. 26, it will be noted that a basic balloon building block, generally indicated at 126, has been formed which is essentially identical to the basic balloon building block 106 of FIG. 14 except that in this instance "D"—here two (2)—completely conventional first balloons 51, 52 have been mounted on diametrically opposite sides of a single rigid rod-like balloon former 100 (100') with the two (2) balloons 51, 52 having their essentially flat planes disposed in face-to-face relation surrounding, and substantially concealing, the rod-like balloon former 100 (100'), as best observed upon inspection of FIGS. 26 and 27 conjointly. Of course, the modified basic balloon building block 126 thus formed serves to simulate the left and right halves of the pod, or shell, as previously described in connection with FIG. 1. Thereafter, a plurality of "m"relatively small, generally spherical, second balloons 54 are partially inflated and their constricted neck portions 128 are, as best shown by reference to FIGS. 29 and 30, knotted or otherwise tied off and inserted into the region between the rigid rod-like former 100 (100') and one or the other of the ovately shaped balloons 51, 52, whereby the "m" second balloons defining the "peas" are frictionally retained in place. If desired, the lowermost slotted end 102 of the rod-like former 100 (100') can then simply be inserted into a pedestal 62 such as that shown in FIGS. 2-7 and 16; or, alternatively, a second plurality of "m" small second balloons 55 (FIG. 1) can be arranged in a cluster attached to the lowermost slotted end 102 of the rod-like former 100 (100') so as to form a support base for the pea pod balloon sculpture 50 in precisely the same manner described above for the balloons 122 in FIGS. 24 and 25.

Figure 31:
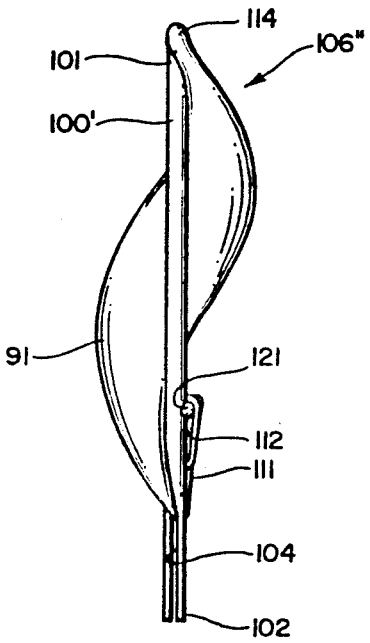
FIG. 31 is an isometric view of a slightly modified manner of attaching a conventional balloon to the rigid rod-like balloon former wherein the balloon is wrapped spirally about the rod-like former between its points of attachment thereto so as to form one of the basic balloon building blocks employed in the balloon sculpture depicted in FIG. 7.

Turning now to FIG. 31, there has been illustrated a modified basic balloon building block 106'' of the type suitable for use in creating the balloon sculpture 90 of FIG. 7. To this end, a rigid rod-like balloon former 100' of the type illustrated and described in connection with FIG. 20 (or, alternatively, the rigid former 100 of FIG. 9) may be employed with a partially inflated balloon 91 having its uninflated constricted neck portion 111 passing through slot 104 in the lower slotted end 102 of the former 100' (100) and with its inflation aperture 112 being secured to the mounting lug 121 (or to the uppermost end 101 of rod-like former 100) in the manner previously described. In this case, however, the partially inflated balloon 91 is wrapped about the unslotted length of the rigid rod-like former 100' (100) in a spiral configuration prior to stretching the apex portion 114 of the balloon 91 over and about the upper end 101 of the former. Those skilled in the art will, of course, appreciate that additional balloons (not shown in FIG. 31) could also be attached to the rod-like former 100' (100) in precisely the same manner to form, for example, the vine-like building block shown in FIG. 7 wherein two (2) such balloons 91, 92 have been wrapped around a single rigid rod-like former 100 (100').

Figure 28:
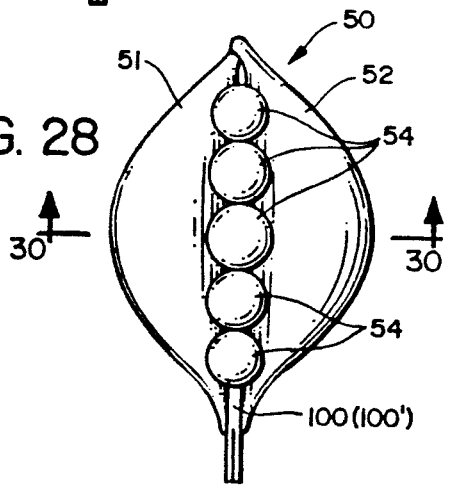
FIG. 28 is a front elevational view similar to that of FIG. 26, but here illustrating a plurality of small, inflated, spherical balloons frictionally retained captive by insertion of their knotted constricted neck portions through the region between the rod-like balloon former and one (1) or the other of the two (2) ovately shaped balloons attached thereto and defining the basic balloon building block, with the overall assembly simulating an exemplary open pea pod of the type shown in FIG. 1 with the two (2) ovately shaped balloons representing the open halves, or shell, of the pod and the plurality of small spherical balloons representing the peas contained therein.
Figure 29:
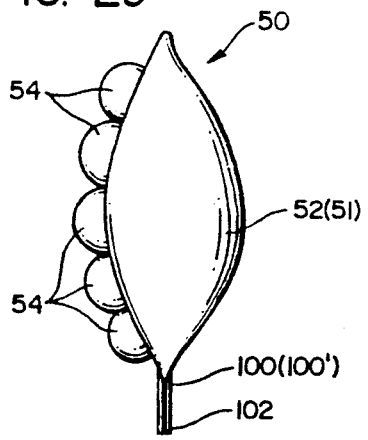
FIG. 29 is a side elevational view of the pea pod sculpture of FIG. 28.
Figure 30:
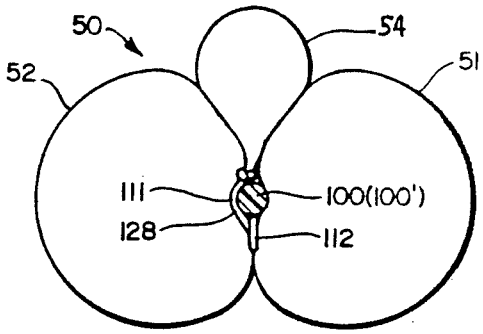
FIG. 30 is a sectional view taken substantially along the line 30—30 in FIG. 28 and depicting how the relatively small spherical balloons simulating the peas are frictionally retained captive in the assembly.
Figure 32:
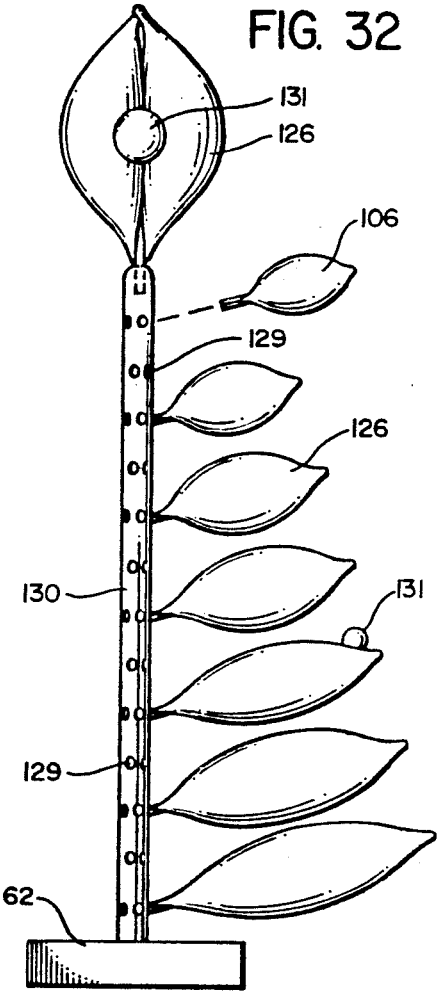
FIG. 32 is a front elevational view, in partially exploded form, illustrating, in highly diagrammatic form, the manner of assembling a multiplicity of basic balloon building blocks to an upright support so as to simulate the Christmas tree balloon sculpture illustrated in FIG. 8.

In order to form the illustrative Christmas tree balloon sculpture 99 depicted in FIG. 8, the present invention needs merely employ a plurality of basic balloon building blocks—such, for example, as those shown at 106 (FIG. 14), 106' (FIG. 23), and/or 126 (FIG. 26)—which are inserted into bores 129 formed in an upright post or simulated tree trunk 130 mounted in a floor or table engaging base or pedestal 62, as best shown in partially exploded form in FIG. 32. Indeed, for relatively large balloon sculptures of this type, it may be desirable to employ multiple basic balloon building blocks disposed in end-to-end relation as shown in, for example, FIGS. 17 and 18 to simulate the longer branches near the base of the tree-like sculpture. It may also be desirable to mount a multiplicity of small, brightly colored and/or phosphorescent, spherical balloons 131 towards the outermost extremities of various ones of the basic balloon building blocks in the same manner that the peas 54 were inserted into the basic balloon building block 126 as shown in FIGS. 28–30 so as to simulate ball-like ornaments of the type commonly used in decorating the branches of Christmas trees.

Figure 33:
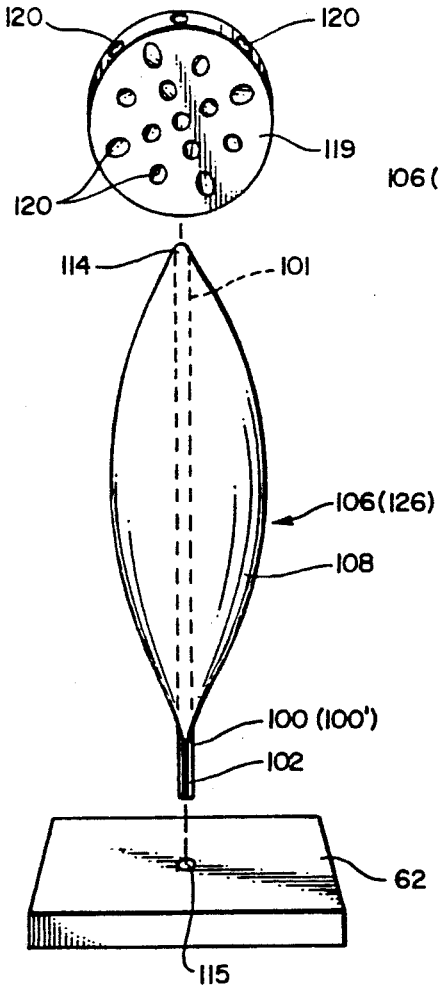
FIG. 33 is a partially exploded isometric view illustrating an exemplary base and a single basic balloon building block of the type shown in FIG. 16, together with a modified exemplary coupling device—viz., the basic components used in the formation of the various balloon sculptures shown in FIGS. 3 through 7.

Turning next to FIGS. 33 and **34*a*–34*d*, the basic components and fabrication steps employed in creating, for example, the floral balloon sculpture 86 of FIG. 4 (as well as the floral balloon sculptures 88, 89 in FIGS. 5 and 6, respectively) will be described in detail. Thus, referring first to FIG. 33, it will be noted that three (3) basic components are employed including: (i) a base 62 for supporting the sculpture in an upright condition on a tabletop or the like (not shown); (ii) a plurality of basic balloon building blocks such, for example, as the building block 106 of FIG. 14 and/or 126 of FIG. 26 [only one (1) such building block 106 is shown in FIG. 33]; and (iii), a disk-like coupling device, such as the device as 119 shown in FIG. 19, having a plurality of axial, radial and angularly related bores 120 formed therein. In this instance, one (1) basic balloon building block 106 (126) simulating a vase or the like, is mounted in a vertically upright position by inserting the lowermost slotted end 102 of the rigid rod-like former 100 (100') into an axial bore 115 formed in the base 62 so as to provide a structure such as that previously described in connection with FIG. 16. The disk-like coupling device 119 is then mounted at the upper end 101 of the rigid rod-like former 100 (100') by insertion of the uppermost end 101 of the former and the apex portion 114 of the balloon 108 mounted thereon into one (1) of the radial bores 120 formed in the coupling device 119**.

Figure 26:
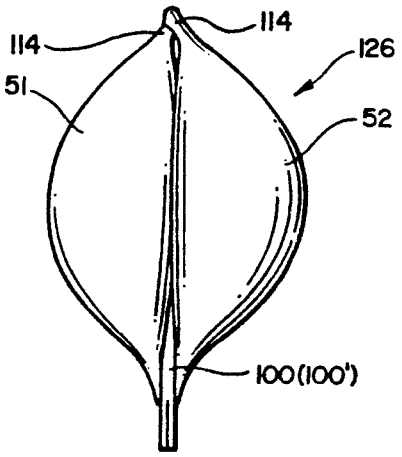
FIG. 26 is an elevational view similar to FIG. 14, but here illustrating the simple basic balloon building block employing two (2) identical ovately shaped conventional balloons coupled to a single rigid rod-like balloon former on diametrically opposite sides thereof.
Figure 27:
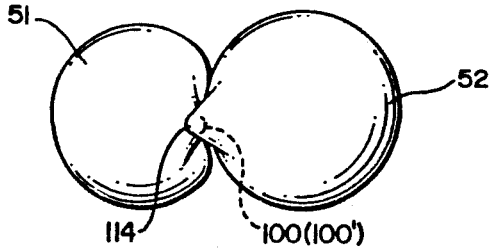
FIG. 27 is a top plan view of the basic balloon building block of FIG. 26.
Figure 34A:
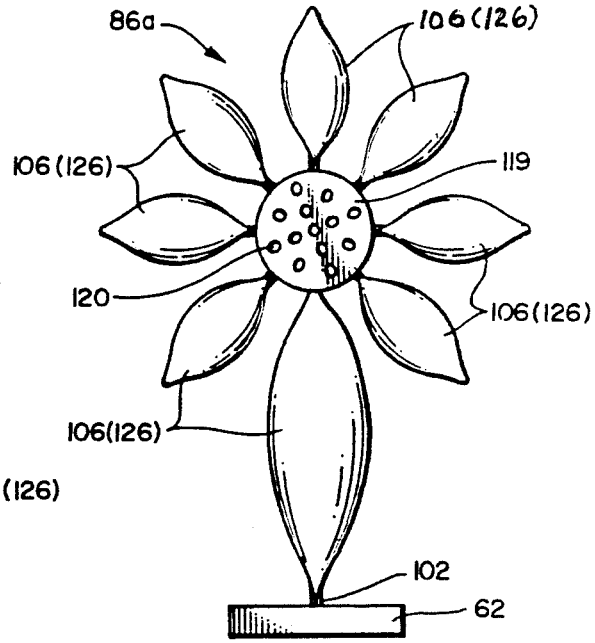
FIGS. 34*a* through 34*d* are front elevational views showing progressive stages of assembly of the balloon sculpture depicted in FIG. 4 while employing the basic components shown in FIG. 33.
Figure 34B:
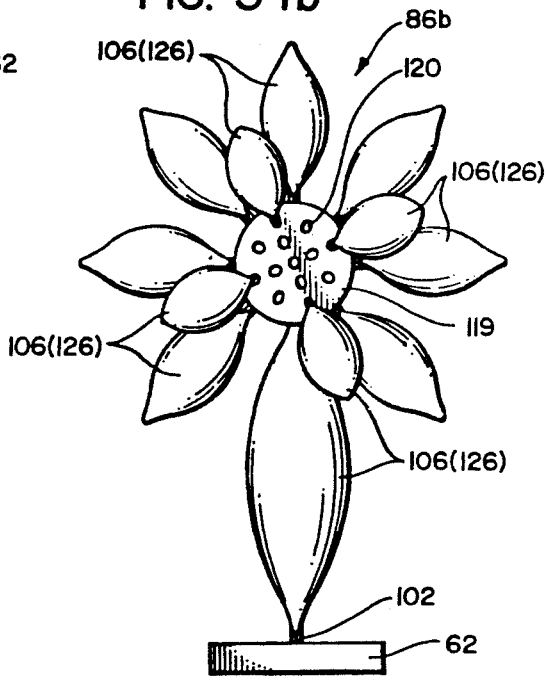
Figure 34C:
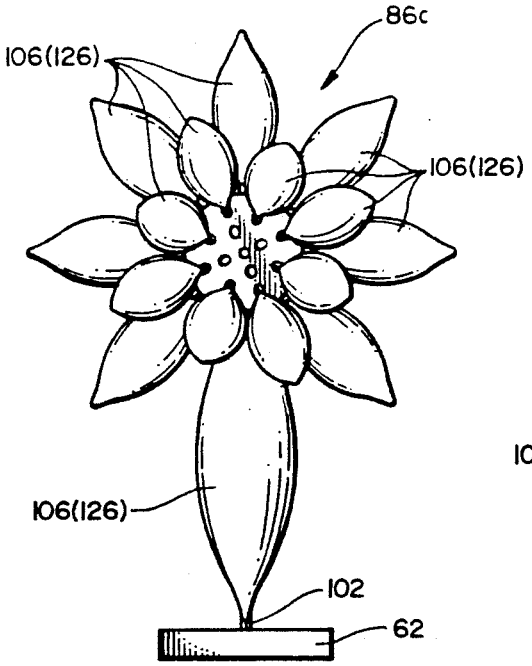
Figure 34D:
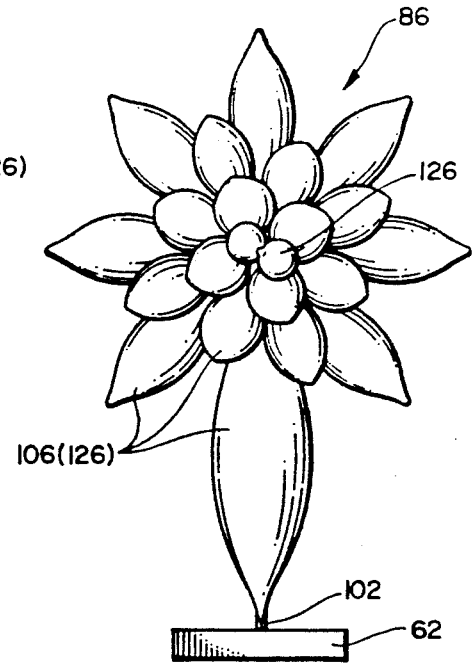
Figure 35:
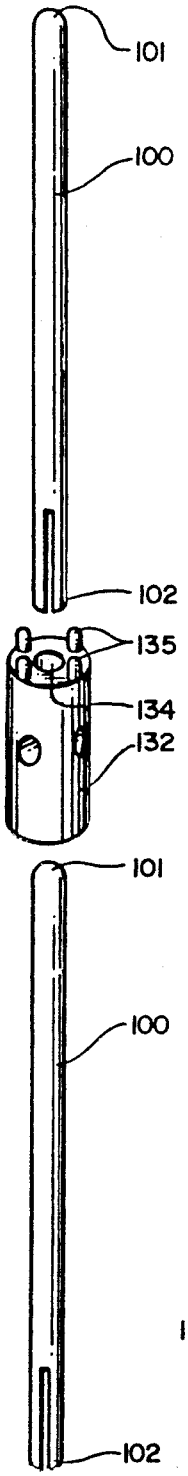
FIG. 35 is an exploded isometric view of a pair of rigid rod-like balloon formers of the type shown in FIG. 9 which are adapted to be assembled in end-to-end relation by means of a modified type of coupler device.

In carrying out this aspect of the invention, a plurality—here seven (7)—of basic balloon building blocks—for example, the building blocks 106, 106' and/or 126 of FIGS. 14, 23 and 26—are inserted into others of the radial bores 120 formed in the coupling device 119 to provide a partially completed balloon sculpture such as shown generally at **86*a* in FIG. 34*a*. Of course, where the balloon designer wishes the finished sculpture to have the same appearance when viewed from both the front and back, each of the seven (7) basic balloon building blocks inserted into the radial bores 120, as well as the basic building block simulating the vase, would be of the type generally indicated at 126 in FIG. 26. Next, a plurality of smaller basic balloon building blocks 106, 106', 126—viz., four (4) such building blocks in FIG. 34*b* and eight (8) such building blocks in FIG. 34*c*—are inserted into angularly related bores 120 formed in the face of the coupling device 119 so as to progressively fill out the interior of the floral balloon sculpture, as indicated generally at 86*b* and 86*c*, respectively, in FIGS. 34*b* and 34*c*—it being understood that this structure would also be replicated on the reverse face of the coupling device 119** where front and back symmetry is desired.

Finally, five (5) additional basic balloon building blocks 106, 106', 126 are inserted into the remaining bores 120 formed in the face of the disk-like coupling device 119 as shown in FIG. **34*d* (again, these additional building blocks would also be inserted on the reverse side of device 119 if front and back symmetry is desired) so as to form a completed balloon sculpture 86 such as that shown in FIG. 4 wherein the coupling device 119 and the multiplicity of rigid rod-like formers 100 (100') are, for all practical purposes, totally obscured from view. And, even when not obscured from view, in those instances where the formers and coupling device are formed of clear acrylic material or the like, they will be essentially invisible and, if formed of green material, the formers will appear to be stems for the simulated flowers in the finished balloon sculpture 86**.

Figure 36:
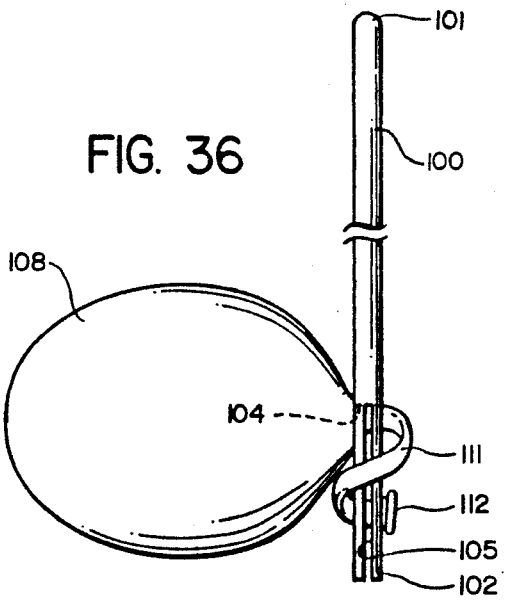
FIG. 36 is a fragmentary front elevational view illustrating particularly another method for attaching the uninflated constricted neck portion of a partially inflated balloon to the lower slotted end of the lowermost one of the rigid rod-like balloon formers of FIG. 35.
Figure 37:
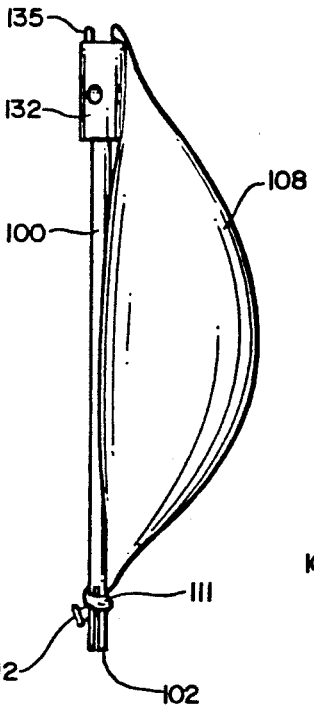
FIG. 37 is a side elevational view of the lowermost one of the rigid rod-like balloon formers of FIG. 35, here shown in assembled relation with the intermediate coupling device and illustrating also the manner of completing assembly of the partially inflated balloon of FIG. 36 thereto by stretching the apex of the balloon over and about one of a plurality of axially extending circumferentially disposed mounting lugs formed on the intermediate coupling device.

Referring now to FIGS. 35–38, yet another modified form of the invention has been depicted. As here shown, a pair of rigid rod-like balloon formers 100 identical to that shown in FIG. 9 are adapted to be mounted in coaxial end-to-end relation by means of an intermediate cylindrical coupling device 132 having an axial bore 134 adapted to receive the lower slotted end 102 of the uppermost rigid rod-like former 100 and the upper end 101 of the lowermost rigid rod-like former 100. In order to permit attachment of the apex portions of a plurality of balloons directly to the cylindrical coupling device 132 (as contrasted with attachment to the upper rounded end 101 of the lowermost rod-like former 100), the coupling device 132 is provided with a plurality—here four (4)—of upright, axially directed, peripherally disposed mounting lugs 135. As best shown in FIG. 36, it will be noted that the uninflated constricted neck portion 111 of a completely conventional balloon 108 is secured to the lowermost rod-like former 100 by: (i) passing the constricted neck portion 111 through a slot 104 which, although not clearly visible in FIG. 36, is identical to that shown in FIG. 10; (ii) wrapping the uninflated constricted neck portion 111 of the partially inflated balloon 108 about the lower slotted end 102 of the rod-like former 100; and (iii), again passing the constricted neck portion 111 of the balloon through the slot 104—i.e., no knotting is required, nor is it necessary to stretch the inflation aperture over and about the upper rounded end 101 of the rigid former 100. Thereafter, the coupling device 132 is mounted on the upper end 101 of the lowermost rod-like former 100 and the apex portion 114 of the partially inflated balloon 108 is stretched upwardly along the unslotted axial length of the former and along the axial length of the coupling device 132 and is fixedly secured on one (1) of the mounting lugs 135 in the manner shown in FIG. 37.

Figure 38:
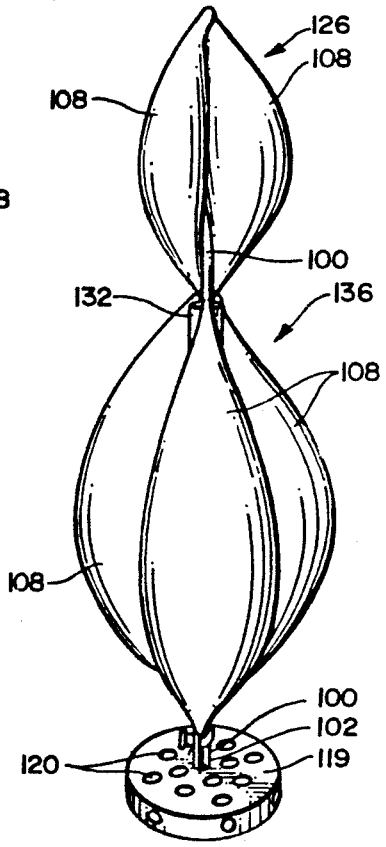
FIG. 38 is an isometric view of a completely assembled balloon sculpture employing the basic components of FIG. 35 wherein three (3) ovately shaped balloons are secured to the lowermost balloon former and two (2) ovately shaped balloons are secured to the uppermost balloon former.

Referring next to FIG. 38, it will be noted that a balloon sculpture, generally indicated at 136, has been formed by: (i) attaching three (3) balloons 108 to a slotted base 102 of the lowermost rod-like balloon former 100 in the manner shown in FIG. 36; (ii) stretching the three (3) balloons 108 upwardly along the unslotted length of the lowermost balloon former 100 so as to essentially surround and conceal the same with the apex portions 114 of the three (3) balloons being stretched over and about three (3) respective different ones of the mounting lugs 135 on the coupling device 132; and (iii), thereafter mounting a basic balloon building block 126, such as that shown in FIG. 26 having two (2) ovately shaped balloons 108 mounted thereon, on the coupling device 132 by inserting the lower slotted end 102 of the uppermost rod-like balloon former 100 into the axial bore 134 in the coupling device. The entire balloon sculpture 136 may then be supported in any desired support base--for example, in a coupling device 119 which permits additional basic balloon building blocks (not shown) to be mounted at the base of the sculpture 136—by inserting the lower slotted end 102 of the lowermost rod-like former 100 into the central axial bore 120 formed in the coupling device 119.

Figure 39:
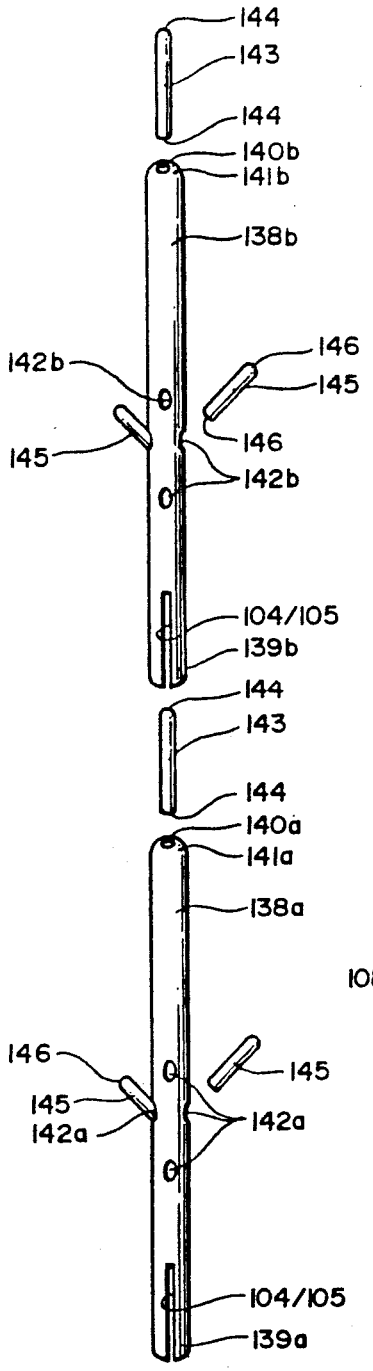
FIG. 39 is a partially exploded isometric view similar to FIG. 35, but here illustrating, in completely disassembled form, a pair of modified rigid rod-like formers adapted to be assembled in end-to-end coaxial relation by means of relatively small diameter connector pins and illustrating also a plurality of separable pin-like mounting lugs which can be selectively located at any of several locations on either or both of the modified rod-like formers.

Even greater flexibility can be attained utilizing the modified exemplary rigid rod-like former and coupler construction shown in FIG. 39. Thus, as here shown, a pair of identical, rigid, rod-like formers 138*a*, 138*b* are provided, each having: (i) a slotted lower end 139*a*, 139*b*, respectively; (ii) an axial bore 140*a*, 140*b*, respectively, formed in the rounded upper ends 141*a*, 141*b*, respectively; and (iii), a plurality of angularly disposed bores 142*c*, 142*b*, respectively, formed at diverse locations along the unslotted lengths of the rigid rod-like formers 138*a*, 138*b*. Rigid rod-like connector pins 143 are provided which can be either permanently or removably mounted in the axial bores 140*a*, 140*b*, such connector pins having rounded ends 144 and being dimensioned such that, when fully seated in the axial bores 140*a*, 140*b*, the pins 143 project axially beyond the upper ends 141*a*, 141*b* of the rigid formers 138*a*, 138*b* a sufficient distance as to permit insertion into the lower slotted ends 139*a*, 139*b* of adjacent coaxial formers 138*a*, 138*b* . . . 138*n* (not shown) but not extending the full axial depth of the slots 104, 105. Finally, the formers are provided with at least one (1) removable pin-like mounting lug 145 having rounded ends 146 which can be inserted into selected one(s) of the angularly related bores 142*a*, 142*b* formed in respective ones of the rigid formers 138*a*, 138*b*.

Thus, the arrangement is such that the balloon designer can mount one (1) or more completely conventional balloons of the same or different sizes on the formers 138*a*, 138*b* in a wide variety of arrays to form interesting and aesthetically pleasing balloon sculptures. Merely by way of example, a typical balloon sculpture that might be created has been shown, and is generally indicated at 137, in FIG. 40. Thus, as here shown, a first pair of conventional balloons 108*a*, 108*b* (only balloon 108*a* is visible in FIG. 40) have been mounted on diametrically opposite sides of the lower rigid former 138*a* (here the front and back) by: (i) passing their constricted neck portions 111 through one of the diametric slots 104, 105; (ii) securing their inflation apertures (not shown in FIG. 40) to the former 138*a* in any of the manners previously described; and (iii), stretching their apex portions 114 over the projecting rounded end 144 of the connector pin 143 disposed in axial bore 140*a*. A second pair of conventional balloons 108*c*, 108*d* (only balloon 108*c* is visible in FIG. 40) have next been mounted in precisely the same way on the second rigid rod-like former 138*b* prior to assembly of the two formers 138*a*, 138*b* together.

In carrying out this form of the invention, the connector pin 143 mounted in axial bore 140*a* of former 138*a* over which the apex portions 114 of the balloons 108*a*, 108*b* are stretched, is then inserted into the slotted end 139*b* of the second rigid former 138*b*. Thereafter, a third pair of conventional balloons 108*e*, 108*f* are attached to diametrically opposite sides of the assemblage by: (i) passing their constricted neck portions 111 through the slotted end 139*a* of former 138*a* and securing their inflation apertures (not shown in FIG. 40) to the former 138*a* in any of the manners previously described; and (ii), thereafter stretching their apex portions 114 over and about the upwardly and outwardly projecting rounded ends 146 of respective ones of a pair of opposed pin-like mounting lugs 145 disposed in angular bores 142*b* (FIG. 39) formed in diametrically opposite sides of the second rigid former 138*b*.

Figure 40:
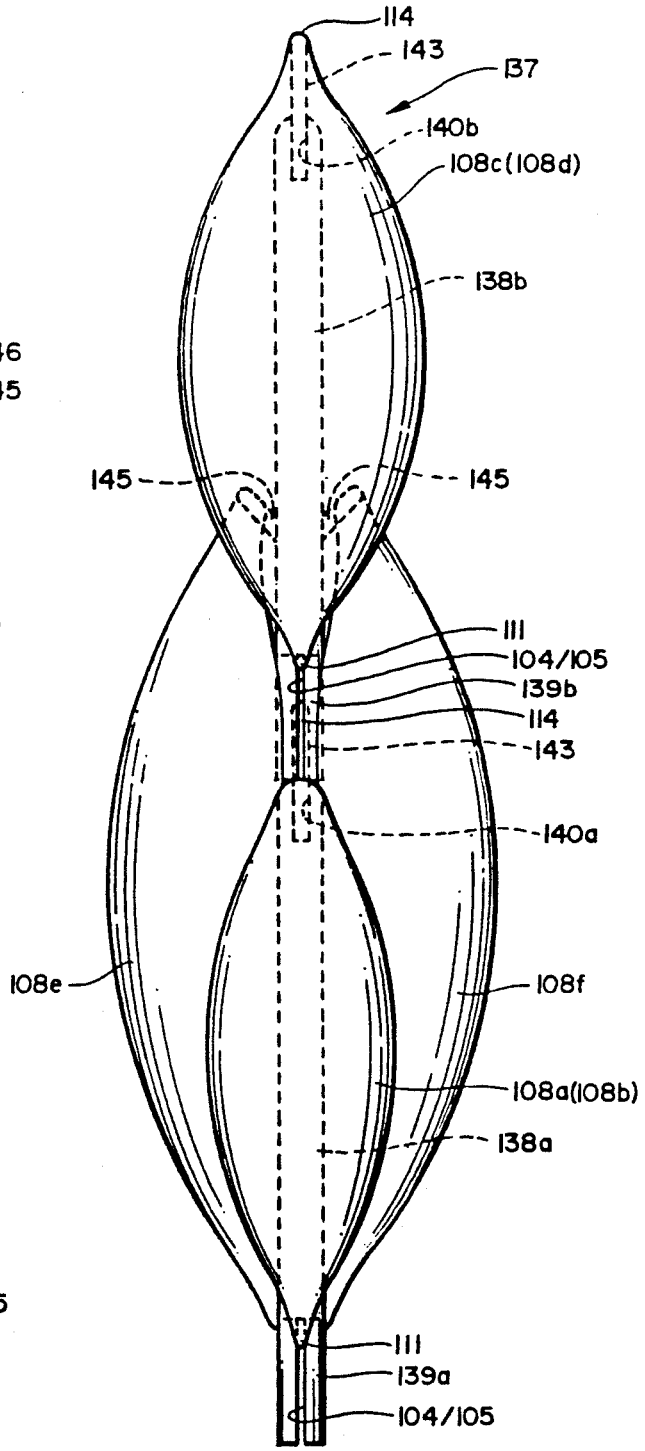
FIG. 40 is a front elevational view of an exemplary balloon sculpture somewhat similar to that shown in FIG. 38, but here utilizing the former assembly depicted in disassembled form in FIG. 39.

Thus, it will be apparent to those skilled in the art of balloon design that a wide variety of different balloon sculptures can be formed using the embodiment of the invention shown in FIGS. 39 and 40. For example, although not shown in the drawings, the pairs of balloons 108*a*/108*b*, 108*c*/108*d* and 108*e*/108*f* need not be symmetrical as shown, but, rather, one balloon in any one, any two, or all of the pairs could be stretched to a different axial length than the other balloon in that(those) pair(s) by attaching the apex portions 114 of one or the other of the balloons 108*a*, 108*b* and 108*c*, 108*d* to an upwardly and latterally projecting pin-like mounting lug 145 positioned along the axial extent of respective ones of rigid formers 138*a*, 138*b* at a different axial location than used for the second balloon of each pair; and/or the apex portion 114 of one or the other of the balloons 108*e*, 108*f* could be attached to either the rounded end 144 of the uppermost connector pin 143 in bore 140*b* of rod 138*b* or, alternatively, to a latterally and upwardly projecting pin-like mounting lug 145 disposed at a different level on rod 138*b* than the mounting lug 145 to which the other of the balloons 108*e*, 108*f* is attached.

Figure 41:
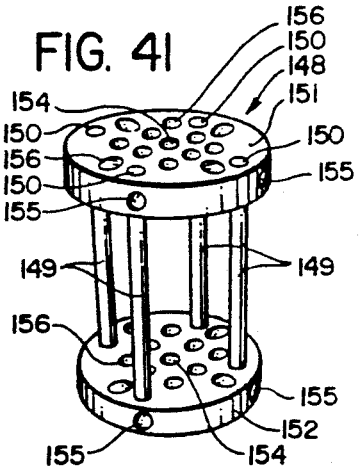
FIG. 41 is an isometric view of yet another modified form of balloon former device embodying features of the present invention and comprising a three-dimensional skeletal former frame including a plurality of rigid rod-like balloon formers used to create a basic balloon building block.

A still further modified form of the invention has been illustrated by way of example in FIG. 41. As here shown, a balloon former, generally indicated at 148, has been provided including a plurality of spaced, parallel, rod-like formers 149 having their uppermost ends mounted in axially extending, peripherally disposed bores 150 formed in an upper disk-like coupling device 151 and their lowermost ends mounted in bores (not shown) in a similar or identical disk-like coupling device 152. Indeed, the two (2) disk like coupling devices 151, 152 may be substantially identical to the disk-like coupling device 119 of FIG. 19 in that they may each include a central axial bore 154, a plurality of peripherally disposed radial bores 155, and a plurality of angularly related bores 156 formed in at least one of their upper and lower faces. Any suitable means (not shown in FIG. 41) can be employed for preventing axial movement of the coupling devices 151, 152 relative to the rigid rod-like formers 149 such, merely by way of example, as by radial pins and/or by providing complementally threaded bores and former extremities. Thus, the arrangement is such that a single uninflated balloon may be inserted into the interior of the former 148 and inflated, with the inflated balloon 158 (FIG. 42) projecting outwardly between the rod-like formers 149 so as to form four (4) inflated bulbous lobes **158*a*–158*d* ,as most clearly shown in FIG. 43, which serve to totally conceal the four (4) rod-like formers 149. Indeed, the resulting balloon sculpture 159 (FIGS. 42, 43) provides an outer appearance of having been formed with four (4) separate balloons when, in fact, there is only a single, completely conventional, spherical balloon 158** employed.

Particularly pleasing aesthetic balloon sculptures can be formed by combining the balloon former 148 of FIG. 41 with, for example, the balloon formers 100, 100' of FIGS. 9 and 20. To this end, central axial bore 154 formed in the disk-like coupling device 151 (FIG. 39) is adapted to receive the lower slotted end 102 of one (1) of the rod-like formers 100, 100' previously described. As a consequence, virtually any balloon sculpture—for example, the balloon sculpture 125 of FIG. 25—can be readily mounted on the balloon sculpture 159 of FIGS. 42 and 43 to provide a composite balloon sculpture such as that generally indicated at 160 in FIG. 44.

Figure 45:
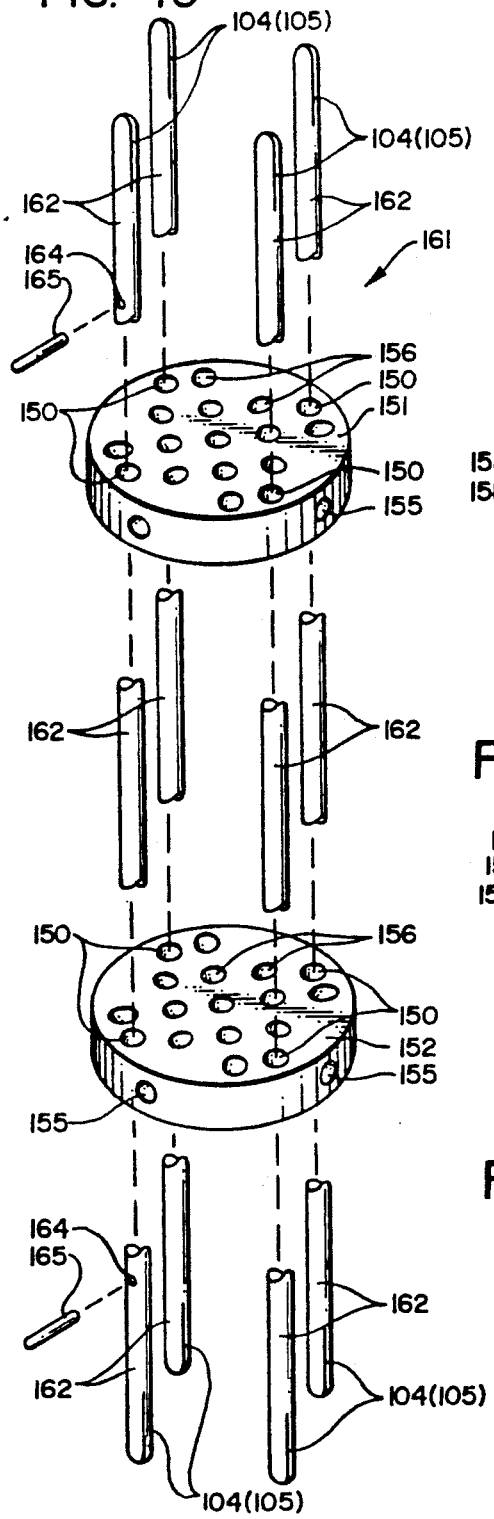
FIG. 45 is a fragmentary, partially exploded, and partially broken away isometric view of a modified skeletal frame-like balloon former device having some similarities to the exemplary former device shown in FIG. 41, but here employing a plurality of relatively long, rigid, rod-like formers which project above and below the upper and lower disk-like coupling devices.

Referring to FIG. 45, a modified type of skeletal frame-like former, generally indicated at 161, has been illustrated in partially exploded and broken away disassembled form, such skeletal frame-like former being similar to that shown in FIG. 41 except that the plurality of rigid rod-like formers here employed and indicated at 162 are considerably longer than the rigid rod-like formers 149 shown in FIG. 41, being dimensioned such that they project well above the upper disk-like coupling device 151 and well below the lower disk-like coupling device 152. Moreover, while the rod-like formers 162 may be identical to any of the formers **100, 100', 138*a*, 138*b* and/or 149 respectively illustrated in FIGS. 9, 20, 39 and 41, they are here shown as including axially extending diametric slots 104/105 at both ends of the former. In carrying out this aspect of the invention, provison may be made for preventing relative axial movement of the upper and lower disk-like coupling devices when a balloon is inflated within the space defined by the coupling devices 151, 152 and the rigid rod-like formers 162. To this end, at least one (1) of the plurality of rod-like formers 162 is provided with a pair of axially spaced diametric bores 164 adapted to receive a locking pin 165** which may take the form of a conventional cotter pin or the like.

Figure 42:
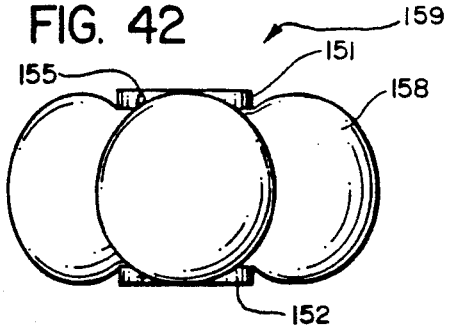
FIG. 42 is a front elevational view illustrating a balloon sculpture formed by inflating a single conventional balloon disposed within the modified balloon former of FIG. 41.
Figure 43:
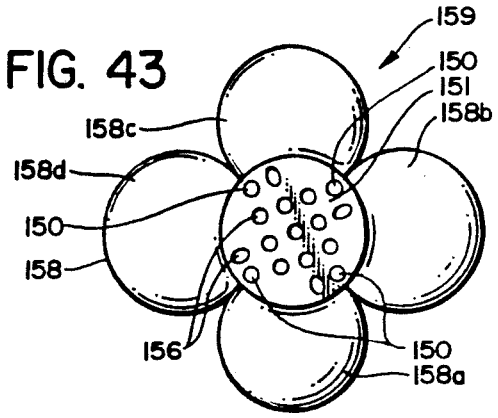
FIG. 43 is a top plan view of the modified basic balloon building block of FIG. 42.
Figure 44:
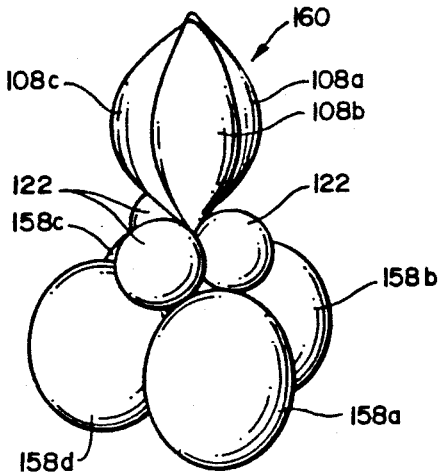
FIG. 44 is an isometric view depicting the resulting composite balloon sculpture when the balloon sculpture of FIG. 25 is mounted on the top of the balloon sculpture of FIG. 42.

In usage of the skeletal frame-like former 161 shown in FIG. 45, a first completely conventional balloon 158 is, while still inflated, inserted into the space defined by the disk-like coupling devices 151, 152 and the plurality of rigid rod-like formers 162, at which point the balloon 158 is inflated in precisely the manner previously described in connection with the embodiment of the invention shown in FIGS. 42 and 43, thus forming four (4) latterally projecting lobes **158*a*–158*d*. Thereafter, four (4) ovately shaped balloons 166*a*–166*d* are secured to respective different ones of the rigid rod-like formers 162 in any of the ways previously described; and, finally, a single spherical balloon 168 is positioned within, and frictionally retained in place by, the upwardly projecting portions of the formers 162, thus forming the balloon sculpture generally indicated at 169 in FIG. 46. Of course, additional basic balloon building blocks (not shown) of the types previously described can then be mounted in any of the exposed bores 155, 156 formed in the coupling devices 151, 152**.

Figure 46:
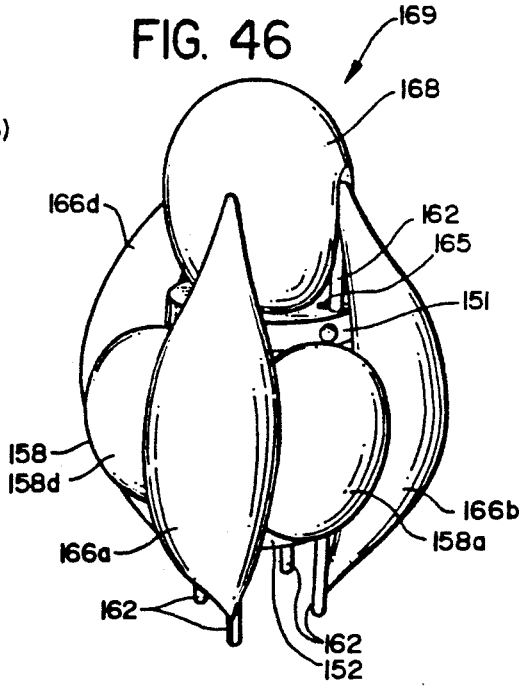
FIG. 46 is an isometric view illustrating the skeletal balloon former device of FIG. 45 in assembled condition and with a plurality—here, six (6)—of conventional balloons attached thereto to form yet another balloon sculpture.
Figure 47:
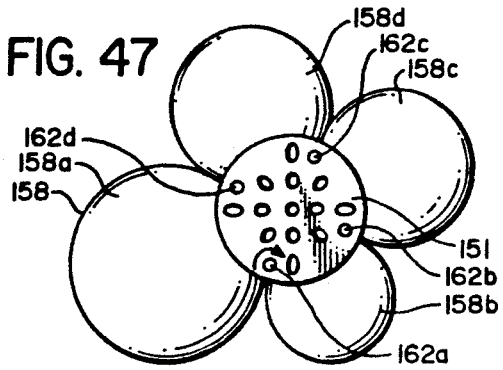
FIG. 47 is a plan view of the modified skeletal frame-like balloon former of FIG. 45, here depicting the assembly after inflation of the balloon disposed between the two (2) disk-like coupling devices, but illustrating a condition wherein the outwardly projecting lobes produced are of unequal size following inflation.
Figure 48:
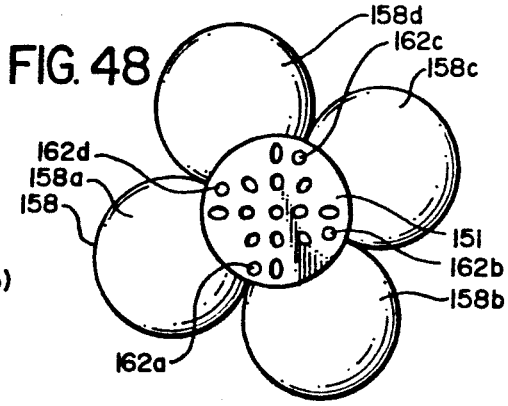
FIG. 48 is a plan view similar to FIG. 47, but here illustrating how the inflated lobes can be made to change size merely by rotation of one or more of the rigid rod-like formers so as to create a balloon sculpture wherein the lobes are of equal size and symmetrical.

One unexpected advantage flowing from the form of the invention illustrated in FIGS. 45 and 46 is more particularly shown in FIGS. 47 and 48. Thus, it has been found that when inflating a balloon 158 in the manner shown in FIGS. 43 and 46, the resultant lobes are not always of uniform size—perhaps due to imperfections in the balloon itself, or perhaps due to slight differences in size and/or shape of the space between adjacent formers 162, or perhaps simply due to the way the user holds the device 161 as the balloon 158 is inflated. Such a result is depicted in FIG. 47 wherein it will be noted that while the lobes **158*c* and 158*d* are of approximately the same size and shape, lobe 158*a* is considerably larger while lobe 158*b* is considerably smaller. When this occurs it is possible to manually correct the situation by physically compressing lobe 158*a* while confining lobes 158*c* and 158*d*** in their original shapes and sizes, although such adjustments are not easily made.

It has been found, however, that the shapes and sizes of the lobes **158*a*–158*d* can be readily changed simply by rotating one or more of the rigid rod-like formers 162. For example, in the situation shown in FIG. 47, rotation of the rigid former designated 162*a* in a clockwise direction as shown by the arrow serves to physically displace the latex sidewall material of the balloon 158 through frictional coaction between the balloon's sidewall and the former, thus decreasing the size of the lobe 158*a* while simultaneously increasing the size of the lobe 158*b*, all without affecting lobes 158*c*, 158*d*. Sufficient clockwise rotation of former 162*a* will quickly produce the result depicted in FIG. 48 where all of the lobes 158*a*–158*d*** are of the same size and shape.

Those skilled in the art will appreciate that rotation of former **162*a* in the opposite or counterclockwise direction will serve to increase the size of lobe 158*a* while decreasing the size of lobe 158*b*. Similarly, other adjacent lobes can be made larger and smaller respectively simply by rotation of the intermediate one of formers 162*b*–162*d*** in the desired direction. As a consequence, the balloon designer can "fine tune" the sculpture to produce lobes of equal and/or unequal size and shape to create whatever impression desired.

Figure 50:
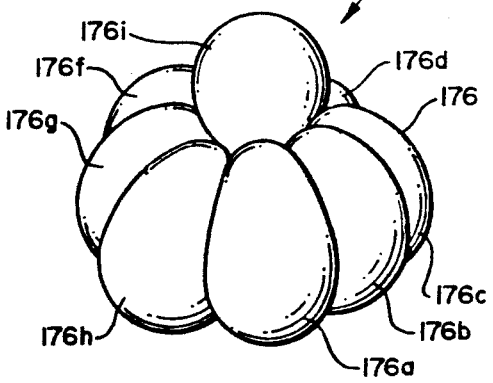
FIG. 50 is an isometric view illustrating a balloon sculpture formed by inflating a single conventional balloon with the frame-like skeletal balloon former of FIG. 49, here depicting how the former produces a sculpture which appears to comprise nine (9) separate balloons, yet which is in reality formed by a single balloon.
Figure 49:
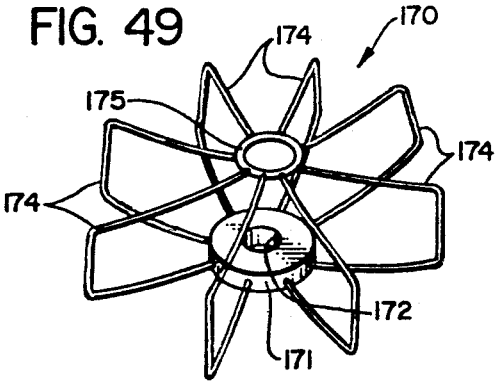
FIG. 49 is an isometric view of yet another exemplary modified embodiment of the invention, here comprising a frame-like skeletal balloon former.
Figure 51:
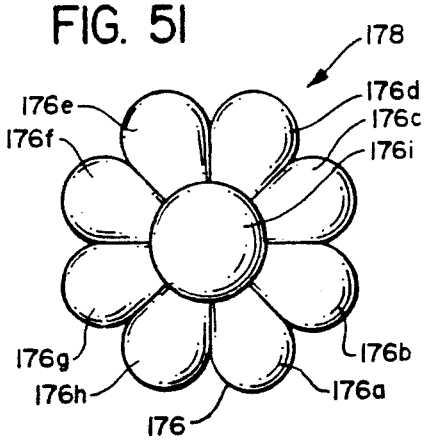
FIG. 51 is a top plan view of the balloon sculpture shown in FIG. 50.

Yet another modified balloon former embodying features of the present invention has been illustrated in FIG. 49 and is generally indicated at 170. In this instance, the balloon former 170 comprises a skeletal frame-like former consisting of: i) an annular disk-shaped coupling device 171 having an axial opening 172 extending therethrough through which an uninflated balloon (not shown) can be inserted; (ii) a plurality—here, eight (8)—of rigid, U-shaped, rod-like formers 174 each having the extremity of one (1) leg mounted radially within the coupling device 171; and (iii), a ring-like coupling device 175 spaced above, and coaxial with, coupling device 171 and adapted to support the free extremity of the other leg of each of the rigid, U-shaped, rod-like balloon forming devices. Thus, the arrangement is such that when an uninflated balloon is positioned within the balloon former 170 with its inflation aperture passing outwardly through opening 172 in coupling device 171 and the balloon is inflated as shown at 176 in FIGS. 50 and 51, the sidewall of the balloon projects outwardly through the openings between adjacent U-shaped rod-like formers 174 to form eight (8) ovate or egg-shaped lobes **176*a*–176*h* and a somewhat smaller, upwardly projecting ovate lobe 176*i* extending upwardly through the opening in the ring-like coupling device 175. The nine (9) lobes 176*a*–176*i* thus formed define a balloon sculpture or centerpiece, generally indicated at 178 in FIGS. 50 and 51, wherein the skeletal frame-like former 170 (FIG. 49) is totally concealed by the lobes 176*a*–176*i*. Moreover, as is made clearly evident upon inspection of FIGS. 50 and 51, although the balloon sculpture 178 there depicted is formed from a single balloon 176**, the visual impression is that the balloon sculpture is formed from nine (9) separate balloons arranged in a cluster.

It will, of course, be understood that the rigid rod-like formers 174 have herein been illustrated and described as being "U-shaped" merely for purpose of example; and, many other configurations can be employed provided only that each device is relatively rigid, sufficiently rod-like or slender as to insure a narrow region of lineal contact with the balloon, and that the former has two (2) free ends for coupling at two (2) points to one (1) or two (2) coupling devices.

Figure 52:
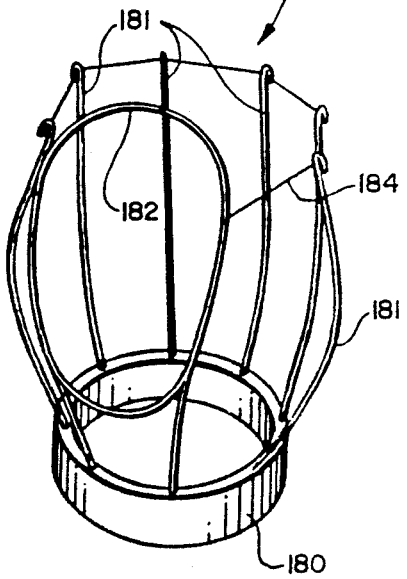
FIG. 52 is an isometric view of a modified frame-like skeletal balloon former somewhat similar in structure and identical in function to that shown by way of example in FIG. 49; and, FIG. 53 is an isometric view illustrating a balloon sculpture simulating a clown's face that can be formed upon inflation of a single balloon within the modified skeletal balloon former of FIG. 52.
Figure 53:
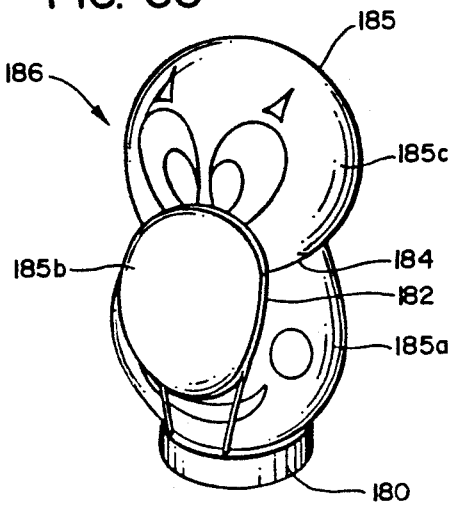

Referring to FIG. 52, yet another modified skeletal frame-like balloon former, generally indicated at 179, has been depicted with the former comprising: (i) a circular coupling device 180; (ii) a plurality of peripherally spaced, vertically upstanding, rigid, rod-like formers 181 mounted on the coupling device 180; (iii) a rigid, generally elliptical rod-like former 182 lying in a generally vertical, forwardly facing plane and coupled to the free upper ends of three (3) of the forwardmost ones of the upstanding rod-like formers 181; and (iv), a rigid, generally horseshoe-shaped rod like former 184 lying in a horizontal plane and being coupled at its free ends to the elliptical rod-like former 182 and at intermediate points to the upper free ends of the remaining vertically upstanding rod-like formers 181. If desired, former 184 may be formed of wire, plastic filament(s), fishing line or the like. The arrangement is such that when a balloon 185 (FIG. 53) is inserted into the skeletal frame-like former 179 of FIG. 52 and is inflated, it tends to form three (3) dominant lobes—viz., (i) a first lobe **185*a* which is essentially contained within the interior of the skeletal frame-like former 179 due to the closely spaced nature of the upstanding rod-like formers 181; (ii) a second, forwardly facing, elliptical lobe 185*b* extending forwardly and outwardly through the relatively large opening defined by the forwardly facing elliptical rod-like former 182; and (iii), a third, upwardly extending, generally spherical lobe 185*c* passing upwardly through the horseshoe-shaped rod-like former 184. As best shown in FIG. 53, the balloon designer can, with a grease pencil or similar writing implement, add various facial features to one (1)—or more of the lobes 185*a*–185*c* so as to create, for example, a clown's head, generally indicated at 186' from the inflated balloon. It will be noted that, in this instance, the bulbous lobes 185*a*–185*c* are not sufficiently large enough to effectively conceal the rigid, rod-like formers 181, 182 and/or 184**; but, by manufacturing the rod-like formers out of clear, transparent acrylic plastic material or the like, the skeletal frame-like formers tend to be less visible.

Those persons skilled in the art relating to balloon design will appreciate from the foregoing description that there have herein been described various arrangements and methods for producing highly creative and original balloon sculptures, yet which are characterized by their simplicity of construction and use, their effectiveness, the pleasing aesthetic appearance of the resulting sculptures, and their inexpensiveness in terms of equipment and fabrication costs. The basic balloon building blocks are highly unique in configuration and appearance; and, readily lend themselves to assembly with other basic balloon building blocks to form virtually any desired balloon sculpture. Moreover, it has been found that many of the balloons employed may be easily reinflated on multiple occasions since it is not generally necessary to knot the constricted neck portions of the balloons after inflation so as to create an effective seal; but, rather, the balloons become self-sealing when stretched through the slots in the formers and have been secured thereto. Indeed, it has been found that it is even possible to reuse balloons which have developed holes in the sidewalls and/or constricted necks merely by insuring that the hole is incorporated in either that portion 114 of the balloon which is stretched over and about the free end of the former—e.g., the free end 101 of the former 100, 100'—or in that portion of the balloon extending through the diametric slot 104, 105 in the former so that the hole is not incorporated in the inflated portion of the balloon. In both of the foregoing instances, the resilient nature of the latex material from which the balloon is formed serves to render the balloon self-sealing in the area of the hole.

I claim:

1. The method of forming a balloon sculpture simulating a tree from a plurality of balloons of the type having a constricted neck portion terminating at one end in an inflation aperture and at the other end in an imperforate inflatable sidewall, said method comprising the steps of:

(a) forming a plurality of basic balloon building blocks each including:

(i) a rigid rod-like balloon former having a first end, a second end, and means defining at least one (1) axially extending diametric slot formed in at least one (1) of the first and second former ends; and, (ii) at least one (1) partially inflated first balloon having its(their) constricted neck portion(s) extending through the slot defining means in the former with at least one (1) of the inflation aperture and/or constricted neck portion of each first balloon being secured to the former, and having the inflated imperforate sidewall of each partially inflated first balloon stretched along the unslotted length of the former and a portion thereof stretched over and about the other of the first and second former ends so as to create a basic balloon building block wherein the former defines a lineal barrier precluding distension of the balloon sidewall juxtaposed therewith in the direction of the former so that each partially inflated balloon has a flat surface abutting the former, tapered pointed upper and lower extremities, and an at least partially ovate configuration in all other planes bisecting the balloon and the former;

(b) establish a vertically upstanding support simulating a tree trunk and having a plurality of radial bores formed therein at diverse axial locations on, and uniformly disposed about, the support with each radial bore being angled downwardly towards the axis of the support; and, (c) inserting the slotted end of the former in each of the plurality of basic balloon building blocks formed in Step (a) in respective different ones of the radial bores in the upstanding support to simulate the branches of a tree.

2. The method of forming a balloon sculpture as set forth in claim 1 wherein at least certain of the basic balloon building blocks formed in Step (a) include a plurality of partially inflated first balloons.

3. The method of forming a balloon sculpture as set forth in claim 1 wherein at least two (2) basic balloon building blocks are coupled together in end-to-end relation to simulate the longer lower branches of the tree-like sculpture.

4. The tree-like balloon sculpture formed by the method set forth in claims 1, 2 or 3.

5. The method of forming a balloon sculpture as set forth in claims 1, 2 or 3 wherein a plurality of partially inflated second balloons having generally spherical shapes are sealed and their constricted neck portions are inserted between diverse ones of the plurality of partially inflated first balloons and the formers to which they are attached so as to frictionally retain the plurality of second balloons in place and simulate a plurality of ball-like ornaments on the tree-like balloon sculpture.

6. The tree-like balloon sculpture formed by the method set forth in claim 5.

* * * * *